US010443340B2

(12) United States Patent
Gamstedt et al.

(10) Patent No.: US 10,443,340 B2
(45) Date of Patent: Oct. 15, 2019

(54) METHOD FOR MAKING CONTROLLED SWELL-RATE SWELLABLE PACKER

(71) Applicant: Halliburton Energy Services, Inc., Houston, TX (US)

(72) Inventors: Pontus Gamstedt, Kattarp (SE); Jens Hinke, Roskilde (DK)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/000,461

(22) Filed: Jun. 5, 2018

(65) Prior Publication Data

US 2018/0291701 A1 Oct. 11, 2018

Related U.S. Application Data

(60) Division of application No. 15/835,782, filed on Dec. 8, 2017, now Pat. No. 10,012,051, which is a division (Continued)

(51) Int. Cl.
*B05D 1/36* (2006.01)
*B05D 7/00* (2006.01)

(Continued)

(52) U.S. Cl.
CPC ..... *E21B 33/1208* (2013.01); *B05D 1/36* (2013.01); *B05D 7/50* (2013.01); *E21B 33/02* (2013.01); *E21B 33/12* (2013.01); *E21B 33/13* (2013.01)

(58) Field of Classification Search
CPC ..... E21B 33/00; E21B 33/02; E21B 33/12; E21B 33/1208; B05D 1/36; B05D 7/50
See application file for complete search history.

(56) References Cited

U.S. PATENT DOCUMENTS 3,385,367 A 5/1968 Kollsman
5,048,605 A * 9/1991 Toon ..... E21B 33/1208 166/187

(Continued)

FOREIGN PATENT DOCUMENTS

CN 101302926 A 11/2008
CN 201460803 U 5/2010

(Continued)

OTHER PUBLICATIONS

"New packer technology for fast, but controlled swell rates," WorldOil, retrieved from https://www.worldoil.com/news/2015/2/25/new-packer-technology-for-fast-but-controlled-swell-rates on Jul. 14, 2019, 2 pages, Feb. 25, 2015. (Year: 2015).*

(Continued)

*Primary Examiner* — William P Fletcher, III
(74) *Attorney, Agent, or Firm* — Scott Richardson; Baker Botts L.L.P.

(57) ABSTRACT

A method of making a controlled swell-rate swellable packer comprises disposing a sealing element about at least a portion of the mandrel, applying a mask onto at least a portion an outer surface of the sealing element, wherein the sealing element comprises a swellable material, and wherein the mask comprises void spaces, and applying a jacket to the sealing element not covered by the mask. The jacket may be disposed such that it covers at least a portion of an outer surface of the sealing element. The jacket is configured to substantially prevent fluid communication between a fluid disposed outside of the jacket and the portion of the outer surface of the sealing element covered by the jacket. The mask may be removed from the sealing element after applying the jacket to the sealing element not covered by the mask.

3 Claims, 8 Drawing Sheets

Related U.S. Application Data of application No. 14/085,447, filed on Nov. 20, 2013, now Pat. No. 9,869,152, which is a continuation of application No. PCT/US2013/063273, filed on Oct. 3, 2013.

(60) Provisional application No. 61/714,653, filed on Oct. 16, 2012.

(51) Int. Cl.

| | |
|---|---|
| ***E21B 33/12*** | (2006.01) |
| ***E21B 33/13*** | (2006.01) |
| ***E21B 33/02*** | (2006.01) |

(56) References Cited

U.S. PATENT DOCUMENTS

| | | | | |
|---|---|---|---|---|
| 5,562,262 | A * | 10/1996 | Pennell | B65H 35/0033 156/577 |
| 7,059,415 | B2 | 6/2006 | Bosma et al. | |
| 7,143,832 | B2 | 12/2006 | Freyer | |
| 7,717,180 | B2 | 5/2010 | Badalamenti et al. | |
| 7,934,554 | B2 | 5/2011 | Roddy | |
| 8,042,618 | B2 | 10/2011 | Weaver et al. | |
| 8,100,190 | B2 | 1/2012 | Weaver et al. | |
| 8,459,366 | B2 | 6/2013 | Sevre | |
| 2008/0011473 | A1* | 1/2008 | Wood | E21B 33/1277 166/179 |
| 2009/0139710 | A1* | 6/2009 | Robisson | C08L 15/005 166/208 |
| 2009/0178800 | A1 | 7/2009 | Korte et al. | |
| 2009/0205841 | A1* | 8/2009 | Kluge | E21B 33/1208 166/387 |
| 2010/0025049 | A1 | 2/2010 | Korte et al. | |
| 2010/0139929 | A1 | 6/2010 | Rytlewski et al. | |
| 2010/0163252 | A1 | 7/2010 | Regnault De La Mothe et al. | |
| 2011/0120733 | A1 | 5/2011 | Vaidya et al. | |
| 2012/0227986 | A1 | 9/2012 | Sevre et al. | |

FOREIGN PATENT DOCUMENTS

| | | | |
|---|---|---|---|
| EA | 005440 | B1 | 2/2005 |
| RU | 2309239 | C2 | 10/2007 |
| RU | 108095 | U1 | 9/2011 |
| WO | 0220941 | A1 | 3/2002 |
| WO | 2008/140888 | A1 | 11/2008 |
| WO | 2008/155564 | A1 | 12/2008 |

OTHER PUBLICATIONS

International Search Report and Written Opinion issued in related PCT Application No. PCT/US2013/063273 dated Jan. 7, 2014, 13 pages.

International Preliminary Report on Patentability issued in related PCT Application No. PCT/US2013/063273 dated Apr. 30, 2015, 12 pages.

Office Action issued in related European application No. 13847947.2 dated Apr. 4, 2019, 4 pages.

* cited by examiner

SAMPLE #1 SAMPLE #2 SAMPLE #3

METHOD FOR MAKING CONTROLLED SWELL-RATE SWELLABLE PACKER

CROSS-REFERENCE TO RELATED APPLICATIONS

The present application claims priority to and is a divisional application of U.S. patent application Ser. No. 15/835,782, filed Dec. 8, 2017, by Gamstedt, et al., and entitled "Controlled Swell-Rate Swellable Packer And Method" which issued as U.S. Pat. No. 10,012,051 on Jul. 3, 2018 and which is a divisional application of U.S. patent application Ser. No. 14/085,447, filed Nov. 20, 2013, by Gamstedt, et al., now issued as U.S. Pat. No. 9,869,152 on Jan. 16, 2018 and entitled "Controlled Swell-Rate Swellable Packer and Method" which is a continuation of and claims priority to International Application No. PCT/US2013/063273 filed on Oct. 3, 2013, by Gamstedt, et al., and entitled "Controlled Swell-Rate Swellable Packer and Method," which claims priority to U.S. Provisional Application No. 61/714,653, filed Oct. 16, 2012, by Gamstedt, et al., and entitled "Controlled Swell-Rate Swellable Packer and Method," all of which are incorporated herein by reference in their entirety.

BACKGROUND

Hydrocarbons (e.g., oil, gas) are commonly produced from hydrocarbon-bearing portions of a subterranean formation via a wellbore penetrating the formation. Oil and gas wells are often cased from the surface location of the wells down to and sometimes through a subterranean formation. A casing string or liner (e.g., steel pipe) is generally lowered into the wellbore to a desired depth. Often, at least a portion of the space between the casing string and the wellbore, i.e., the annulus, is then typically filled with cement (e.g., cemented) to secure the casing string within the wellbore. Once the cement sets in the annulus, it holds the casing string in place and prevents flow of fluids to, from, or between various portions of a subterranean formation through which the well passes.

During the drilling, servicing, completing, and/or reworking of wells (e.g., oil and/or gas wells), a great variety of downhole wellbore servicing tools are used. For example, but not by way of limitation, it is often desirable to isolate two or more portions of a wellbore, such as during the performance of a stimulation (e.g., perforating and/or fracturing) operation. Additionally or alternatively, it may also be desirable to isolate various portions of a wellbore during completion (such as cementing) operations. Downhole wellbore servicing tools (i.e., isolation tools) generally including packers and/or plugs are designed for these general purposes and are well known in the art of producing oil and gas. Packers may also be utilized to secure a casing string within a wellbore.

SUMMARY

In an embodiment, a controlled swell-rate swellable packer comprises a mandrel; a sealing element, and a jacket. The sealing element is disposed about at least a portion of the mandrel, and the jacket covers at least a portion of an outer surface of the sealing element. The jacket is configured to substantially prevent fluid communication between a fluid disposed outside of the jacket and the portion of the outer surface of the sealing element covered by the jacket. The controlled swell-rate swellable packer may also include one or more end stops disposed about the mandrel adjacent the sealing element, and the one or more end stops maybe configured to retain the sealing element about the portion of the mandrel. The sealing element may comprise a swellable material. The swellable material may comprise a water-swellable material, and the water-swellable material may comprise a tetrafluorethylene/propylene copolymer (TFE/P), a starch-polyacrylate acid graft copolymer, a polyvinyl alcohol/cyclic acid anhydride graft copolymer, an isobutylene/maleic anhydride copolymer, a vinyl acetate/acrylate copolymer, a polyethylene oxide polymer, graft-poly(ethylene oxide) of poly(acrylic acid), a carboxymethyl cellulose type polymer, a starch-polyacrylonitrile graft copolymer, polymethacrylate, polyacrylamide, an acrylamide/acrylic acid copolymer, poly(2-hydroxyethyl methacrylate), poly(2-hydroxypropyl methacrylate), a non-soluble acrylic polymer, a highly swelling clay mineral, sodium bentonite, sodium bentonite having as main ingredient montmorillonite, calcium bentonite, derivatives thereof, or combinations thereof. The swellable material may comprise an oil-swellable material, and the oil-swellable material may comprise an oil-swellable rubber, a natural rubber, a polyurethane rubber, an acrylate/butadiene rubber, a butyl rubber (IIR), a brominated butyl rubber (BUR), a chlorinated butyl rubber (CIIR), a chlorinated polyethylene rubber (CM/CPE), an isoprene rubber, a chloroprene rubber, a neoprene rubber, a butadiene rubber, a styrene/butadiene copolymer rubber (SBR), a sulphonated polyethylene (PES), chlorsulphonated polyethylene (CSM), an ethylene/acrylate rubber (EAM, AEM), an epichlorohydrin/ethylene oxide copolymer rubber (CO, ECO), an ethylene/propylene copolymer rubber (EPM), ethylene/propylene/diene terpolymer (EPDM), a peroxide crosslinked ethylene/propylene copolymer rubber, a sulphur crosslinked ethylene/propylene copolymer rubber, an ethylene/propylene/diene terpolymer rubber (EPT), an ethylene/vinyl acetate copolymer, a fluoro silicone rubber (FVMQ), a silicone rubber (VMQ), a poly 2,2,1-bicyclo heptene (polynorbornene), an alkylstyrene polymer, a crosslinked substituted vinyl/acrylate copolymer, derivatives thereof, or combinations thereof. The swellable material may comprise a water-and-oil-swellable material, and the water-and-oil-swellable material may comprise a nitrile rubber (NBR), an acrylonitrile/butadiene rubber, a hydrogenated nitrile rubber (HNBR), a highly saturated nitrile rubber (HNS), a hydrogenated acrylonitrile/butadiene rubber, an acrylic acid type polymer, poly(acrylic acid), polyacrylate rubber, a fluoro rubber (FKM), a perfluoro rubber (FFKM), derivatives thereof, or combinations thereof. The jacket may comprise a primer coating layer, and the primer coating layer may be characterized by a thickness of less than about 10 microns. The jacket may comprise at least one top coating layer, and the top coating layer may comprise a plastic, a polymeric material, a polyethylene, polypropylene, a fluoro-elastomer, a fluoro-polymer, a fluoropolymer elastomer, polytetrafluoroethylene, a tetrafluoroethylene/propylene copolymer (TFE/P), a polyamide-imide (PAI), a polyimide, a polyphenylene sulfide (PPS), or combinations thereof. The top coating layer may comprise a flexible coating material or a partially flexible coating material. The top coating layer may be characterized by a thickness of from about 10 microns to about 100 microns. The controlled swell-rate swellable packer may also include a retention coating layer, and the retention coating layer may be characterized by a thickness of from about 1 micron to about 100 microns.

In an embodiment, a method of making a controlled swell-rate swellable packer comprises applying a mask onto at least a portion of an outer surface of a sealing element, applying a jacket to the sealing element when the mask is applied, removing the mask after applying the jacket, and providing a controlled swell-rate swellable packer. The sealing element comprises a swellable material. The mask comprises void spaces, and the mask substantially prevents the application of the jacket except in the void spaces. The method may also include applying a retention coating layer onto the outer surface of the sealing element, and the retention coating layer may be applied onto an outer surface of the controlled swell-rate swellable packer subsequent to removing the mask.

In an embodiment, a method of utilizing a controlled swell-rate swellable packer comprises disposing a tubular string comprising a controlled swell-rate swellable packer incorporated therein within a wellbore in a subterranean formation, and activating the controlled swell-rate swellable packer. The controlled swell-rate swellable packer comprises: a sealing element and a jacket, where the sealing element comprises a swellable material. The jacket covers at least a portion of an outer surface of the sealing element, and the jacket is substantially impermeable to a fluid that is configured to cause the sealing element to swell upon contact between the sealing element and the fluid. The method may also include allowing the controlled swell-rate swellable packer to swell an amount between about 105% to about 500% based on the volume of the swellable material of the sealing element prior to activating the controlled swell-rate swellable packer. The method may also include allowing the controlled swell-rate swellable packer to swell an amount between about 125% to about 200% based on the volume of the swellable material of the sealing element prior to activating the controlled swell-rate swellable packer. A swell gap of the sealing element may increase an amount between about 105% to about 250% based on the swell gap of the sealing element prior to activating the controlled swell-rate swellable packer. A swell gap of the sealing element may increase an amount between about 110% to about 150% based on the swell gap of the sealing element prior to activating the controlled swell-rate swellable packer. The controlled swell-rate swellable packer may further comprises a retention coating layer. The method may also include isolating at least two adjacent portions of the wellbore using the controlled swell-rate swellable packer subsequent to activating the controlled swell-rate swellable packer. Activating the controlled-rate swellable packer may comprise contacting at least a portion of the controlled swell-rate packer with a swelling agent, and allowing the sealing element to swell. The sealing element may have a linear swell-rate, or the sealing element may have a non-linear swell-rate. The method may also include controlling a swell-rate of the sealing element by varying at least one of: a type and/or composition of a swelling material, a type and/or composition of a jacket, a number of layers in the jacket, a pattern of a mask, a ratio between a portion of an outer surface of a sealing element exposed to a swelling agent and a portion of the outer surface of the sealing element cover by the jacket, a type and/or composition of the swelling agent, or combinations thereof.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
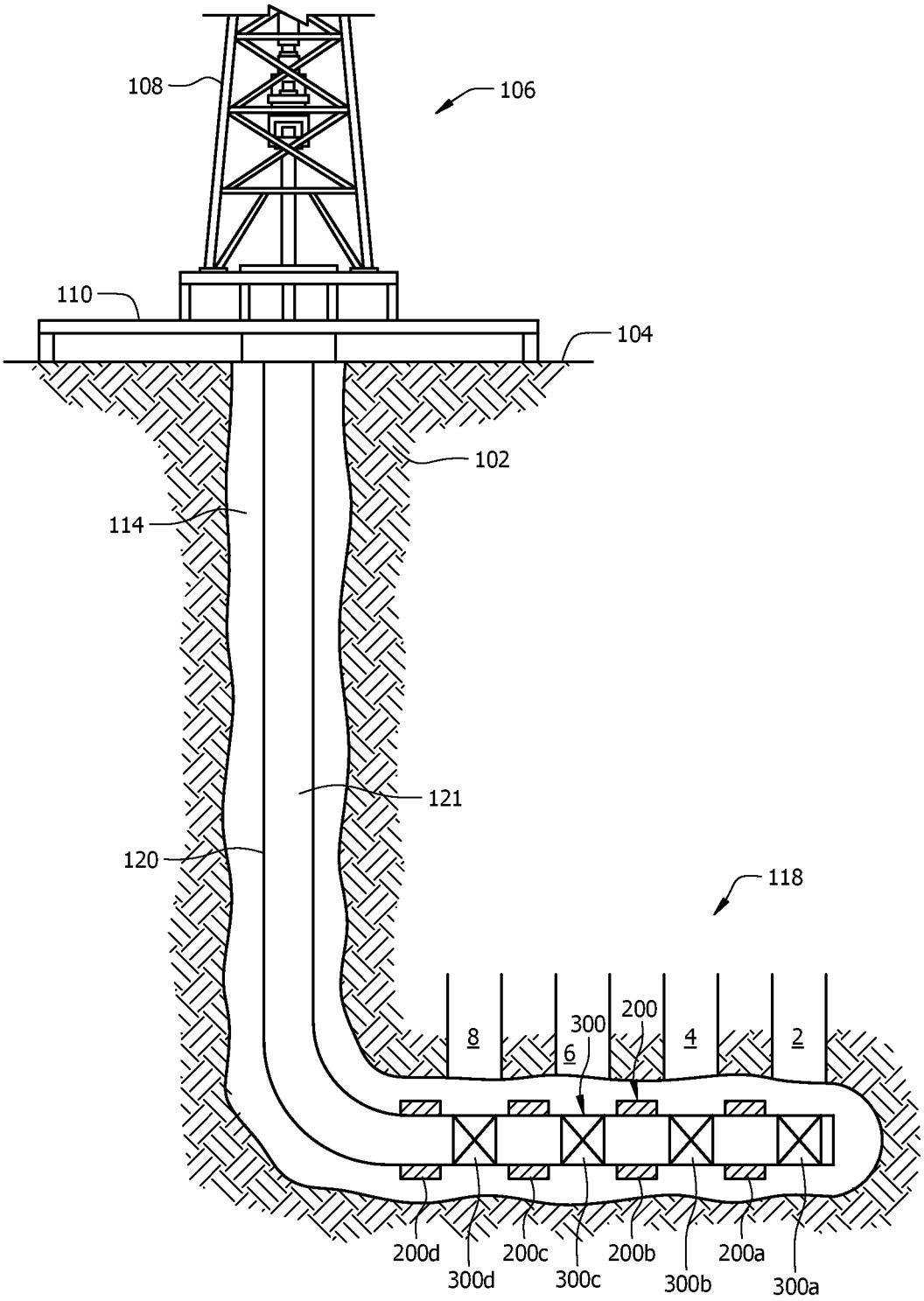
FIG. 1 is a simplified cutaway view of an embodiment of an environment in which a controlled swell-rate swellable packer may be employed.

In the drawings and description that follow, like parts are typically marked throughout the specification and drawings with the same reference numerals, respectively. In addition, similar reference numerals may refer to similar components in different embodiments disclosed herein. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "up-hole," "upstream," or other like terms shall be construed as generally from the formation toward the surface or toward the surface of a body of water; likewise, use of "down," "lower," "downward," "down-hole," "downstream," or other like terms shall be construed as generally into the formation away from the surface or away from the surface of a body of water, regardless of the wellbore orientation. Use of any one or more of the foregoing terms shall not be construed as denoting positions along a perfectly vertical axis.

Unless otherwise specified, use of the term "subterranean formation" shall be construed as encompassing both areas below exposed earth and areas below earth covered by water such as ocean or fresh water.

Disclosed herein are embodiments of wellbore servicing methods, as well as apparatuses and systems that may be utilized in performing the same. Particularly, disclosed herein are one or more embodiments of a wellbore servicing apparatus comprising a controlled swell-rate swellable packer (CSSP) and systems and methods of employing the same. In an embodiment, the CSSP, as will be disclosed herein, may allow an operator to deploy a swellable packer within a subterranean formation and to control the rate at which the CSSP will expand so as to isolate two or more portions of a wellbore and/or two or more zones of a subterranean formation.

Referring to FIG. 1, an embodiment of an operating environment in which a wellbore servicing apparatus and/or system may be employed is illustrated. It is noted that although some of the figures may exemplify horizontal or vertical wellbores, the principles of the apparatuses, systems, and methods disclosed may be similarly applicable to horizontal wellbore configurations, conventional vertical wellbore configurations, deviated wellbore configurations, and any combination thereof. Therefore, the horizontal, deviated, or vertical nature of any figure is not to be construed as limiting the wellbore to any particular configuration.

As depicted in FIG. 1, the operating environment generally comprises a wellbore 114 that penetrates a subterranean formation 102 comprising a plurality of formation zones 2, 4, 6 and 8 for the purpose of recovering hydrocarbons, storing hydrocarbons, disposing of carbon dioxide, or the like. The wellbore 114 may extend substantially vertically away from the earth's surface over a vertical wellbore portion, or may deviate at any angle from the earth's surface 104 over a deviated or horizontal wellbore portion 118. In alternative operating environments, portions or substantially all of the wellbore 114 may be vertical, deviated, horizontal, and/or curved. The wellbore 114 may be drilled into the subterranean formation 102 using any suitable drilling technique. In an embodiment, a drilling or servicing rig 106 disposed at the surface 104 comprises a derrick 108 with a rig floor 110 through which a tubular string (e.g., a drill string, a tool string, a segmented tubing string, a jointed tubing string, or any other suitable conveyance, or combinations thereof) generally defining an axial flowbore may be positioned within or partially within the wellbore 114. In an embodiment, the tubular string may comprise two or more concentrically positioned strings of pipe or tubing (e.g., a first work string may be positioned within a second work string). The drilling or servicing rig 106 may be conventional and may comprise a motor driven winch and other associated equipment for lowering the tubular string into the wellbore 114. Alternatively, a mobile workover rig, a wellbore servicing unit (e.g., coiled tubing units), or the like may be used to lower the work string into the wellbore 114. In such an embodiment, the tubular string may be utilized in drilling, stimulating, completing, or otherwise servicing the wellbore, or combinations thereof. While FIG. 1 depicts a stationary drilling rig 106, one of ordinary skill in the art will readily appreciate that mobile workover rigs, wellbore servicing units (such as coiled tubing units), and the like may be employed.

In the embodiment of FIG. 1, at least a portion of the wellbore 114 is lined with a wellbore tubular 120 such as a casing string and/or liner defining an axial flowbore 121. In the embodiment of FIG. 1, at least a portion of the wellbore tubular 120 is secured into position against the formation 102 via a plurality of CSSPs 200 (e.g., a first CSSP 200*a*, a second CSSP 200*b*, a third CSSP 200*c*, and a fourth CSSP 200*d*). Additionally, in an embodiment, at least a portion of the wellbore tubular 120 may be partially secured into position against the formation 102 in a conventional manner with cement. In additional or alternative operating environments, a CSSP like CSSP 200, as will be disclosed herein, may be similarly incorporated within (and similarly utilized to secure) any suitable tubular string and used to engage and/or seal against an outer tubular string. Examples of such a tubular string include, but are not limited to, a work string, a tool string, a segmented tubing string, a jointed pipe string, a coiled tubing string, a production tubing string, a drill string, the like, or combinations thereof. In an embodiment, a CSSP like CSSP 200 may be used to isolate two or more adjacent portions or zones within subterranean formation 102 and/or wellbore 114.

Referring to the embodiment of FIG. 1, the wellbore tubular 120 may further have incorporated therein at least one wellbore servicing tool (WST) 300 (e.g., a first WST 300*a*, a second WST 300*b*, a third WST 300*c*, and a fourth WST 300*d*). In an embodiment, one or more of the WSTs 300 may comprise an actuatable stimulation assembly, which may be configured for the performance of a wellbore servicing operation, such as, a stimulation operation. Various stimulation operations can include, but are not limited to a perforating operation, a fracturing operation, an acidizing operation, or any combination thereof.

Figure 2:
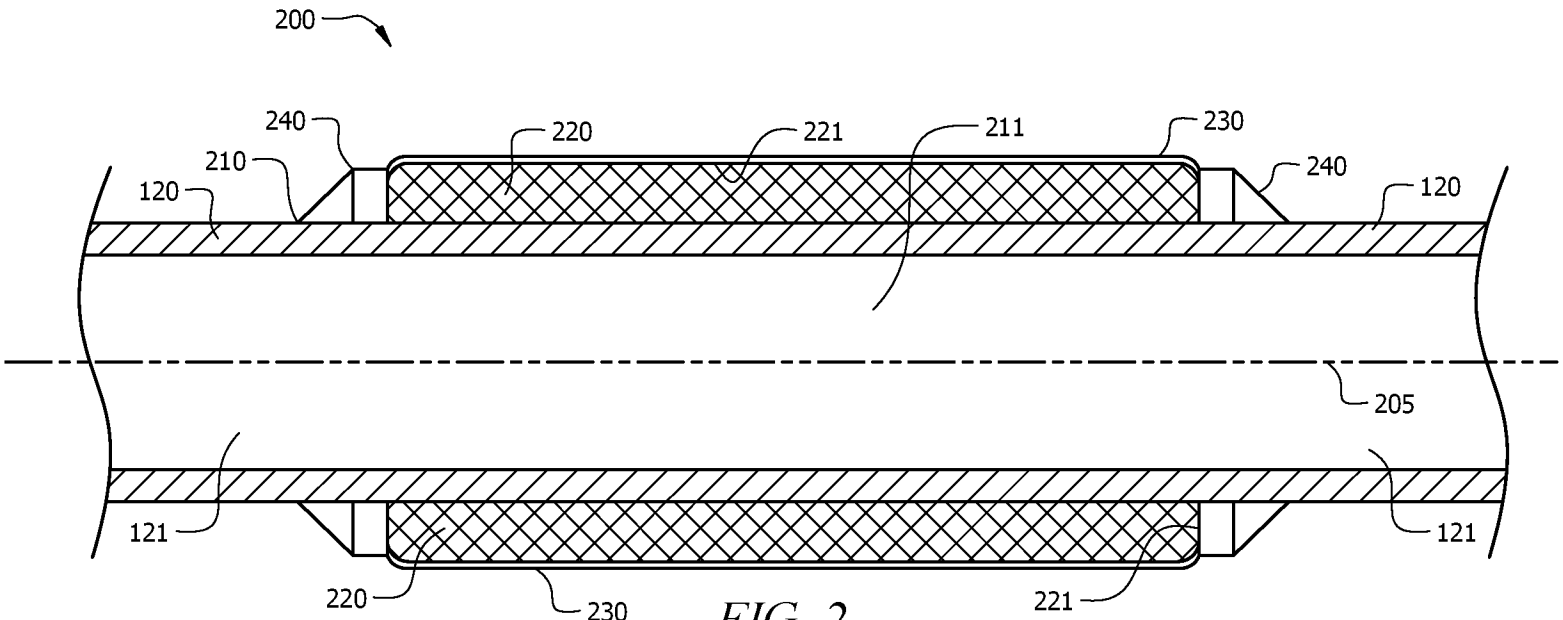
FIG. 2 is a cross-sectional view of an embodiment of a controlled swell-rate swellable packer.

Referring to FIG. 2, an embodiment of a CSSP 200 is illustrated. In the embodiment of FIG. 2, the CSSP 200 generally comprises a mandrel 210, a sealing element 220 disposed circumferentially about/around at least a portion of the mandrel 210, and a jacket 230 covering at least a portion of the sealing element 220. Also, the CSSP 200 may be characterized with respect to a central or longitudinal axis 205.

In an embodiment, the mandrel 210 generally comprises a cylindrical or tubular structure or body. The mandrel 210 may be coaxially aligned with the central axis 205 of the CSSP 200. In an embodiment, the mandrel 210 may comprise an unitary structure (e.g., a single unit of manufacture, such as a continuous length of pipe or tubing); alternatively, the mandrel 210 may comprise two or more operably connected components (e.g., two or more coupled subcomponents, such as by a threaded connection). Alternatively, a mandrel like mandrel 210 may comprise any suitable structure; such suitable structures will be appreciated by those of skill in the art upon viewing this disclosure. The tubular body of the mandrel 210 generally defines a continuous axial flowbore 211 that allows fluid movement through the mandrel 210.

In an embodiment, the mandrel 210 may be configured for incorporation into the wellbore tubular 120; alternatively, the mandrel 210 may be configured for incorporation into any suitable tubular string, such as for example a work string, a tool string, a segmented tubing string, a jointed pipe string, a coiled tubing string, a production tubing string, a drill string, the like, or combinations thereof. In such an embodiment, the mandrel 210 may comprise a suitable connection to the wellbore tubular 120 (e.g., to a casing string member, such as a casing joint). Suitable connections to a casing string will be known to those of skill in the art. In such an embodiment, the mandrel 210 is incorporated within the wellbore tubular 120 such that the axial flowbore 211 of the mandrel 210 is in fluid communication with the axial flowbore 121 of the wellbore tubular 120.

In an embodiment, the CSSP 200 may comprise one or more optional retaining element 240. Generally, an optional retaining element 240 may be disposed circumferentially about the mandrel 210 adjacent to and abutting the sealing element 220 on each side of the sealing element 220, as seen in the embodiment of FIG. 2. Alternatively, the optional retaining element 240 may be adjacent to and abutting the sealing element 220 on one side only, such as for example on a lower side of the sealing element 220, or on an upper side of the sealing element 220. The optional retaining element 240 may be secured onto the mandrel by any suitable retaining mechanism, such as for example screws, pins, shear pins, retaining bands, and the like, or combinations thereof. The optional retaining element 240 may comprise a plurality of elements, including but not limited to one or more spacer rings, one or more slips, one or more slip segments, one or more slip wedges, one or more extrusion limiters, and the like, or combinations thereof. In an embodiment, the optional retaining element 240 may prevent or limit the longitudinal movement (e.g., along the central axis 205) of the sealing element 220 about the mandrel 210, while the sealing element 220 disposed circumferentially about the mandrel 210 is placed within the wellbore and/or subterranean formation. In an embodiment, the optional retaining element 240 may prevent or limit the longitudinal expansion (e.g., along the central axis 205) of the sealing element 220, while allowing the radial expansion of the sealing element 220.

In an embodiment, the sealing element 220 may generally be configured to selectively seal and/or isolate two or more portions of an annular space surrounding the CSSP 200 (e.g., between the CSSP 200 and one or more walls of the wellbore 114), for example, by selectively providing a barrier extending circumferentially around at least a portion of the exterior of the CSSP 200. In an embodiment, the sealing element 220 may generally comprise a hollow cylindrical structure having an interior bore (e.g., a tube-like and/or a ring-like structure). The sealing element 220 may comprise a suitable internal diameter, a suitable external diameter, and/or a suitable thickness, for example, as may be selected by one of skill in the art upon viewing this disclosure and in consideration of factors including, but not limited to, the size/diameter of the mandrel 210, the wall against which the sealing element is configured to engage, the force with which the sealing element is configured to engage such surface(s), or other related factors. For example, the internal diameter of the sealing element 220 may be about the same as an external diameter of the mandrel 210. In an embodiment, the sealing element 220 may be in sealing contact (e.g., a fluid-tight seal) with the mandrel 210. While the embodiment of FIG. 2 illustrates a CSSP 200 comprising a single sealing element 220, one of skill in the art, upon viewing this disclosure, will appreciate that a similar CSSP may comprise two, three, four, five, or any other suitable number of sealing elements like sealing element 220.

In an embodiment, the sealing element 220 comprises a swellable material. For purposes of the disclosure herein, a swellable material may be defined as any material (e.g., a polymer, such as for example an elastomer) that swells (e.g., exhibits an increase in mass and volume) upon contact with a selected fluid, i.e., a swelling agent. Herein the disclosure may refer to a polymer and/or a polymeric material. It is to be understood that the terms polymer and/or polymeric material herein are used interchangeably and are meant to each refer to compositions comprising at least one polymerized monomer in the presence or absence of other additives traditionally included in such materials. Examples of polymeric materials suitable for use as part of the swellable material include, but are not limited to homopolymers, random, block, graft, star- and hyper-branched polyesters, copolymers thereof, derivatives thereof, or combinations thereof. The term "derivative" herein is defined to include any compound that is made from one or more of the swellable materials, for example, by replacing one atom in the swellable material with another atom or group of atoms, rearranging two or more atoms in the swellable material, ionizing one of the swellable materials, or creating a salt of one of the swellable materials. The term "copolymer" as used herein is not limited to the combination of two polymers, but includes any combination of any number of polymers, e.g., graft polymers, terpolymers, and the like.

For purposes of disclosure herein, the swellable material may be characterized as a resilient, volume changing material. In an embodiment, the swellable material of the sealing element 220 may swell by from about 105% to about 500%, alternatively from about 115% to about 400%, or alternatively from about 125% to about 200%, based on the original volume at the surface, i.e., the volume of the swellable material of the sealing element 220 prior to contacting the sealing element 220 (e.g., swellable material) with the swelling agent. In an embodiment, a swell gap of the sealing element 220 may increase by from about 105% to about 250%, alternatively from about 110% to about 200%, or alternatively from about 110% to about 150%, based on the swell gap of the sealing element 220 prior to contacting the sealing element 220 (e.g., swellable material) with the swelling agent. For purposes of the disclosure herein, the swell gap is defined by an increase in a radius of the sealing element (e.g., swellable material) upon swelling divided by a thickness of the sealing element (e.g., swellable material) prior to swelling. As will be appreciated by one of skill in the art, and with the help of this disclosure, the extent of swelling of a sealing element (e.g., a swellable material) may depend upon a variety of factors, such as for example the downhole environmental conditions (e.g., temperature, pressure, composition of formation fluid in contact with the sealing element, specific gravity of the fluid, pH, salinity, etc.). For purposes of the disclosure herein, upon swelling to at least some extent (e.g., partial swelling, substantial swelling, full swelling), the swellable materials may be referred to as "swelled materials."

In an embodiment, the sealing element 220 may be configured to exhibit a radial expansion (e.g., an increase in exterior diameter) upon being contacted with a swelling agent. In an embodiment, the swelling agent may be a water-based fluid (e.g., aqueous solutions, water, etc.), an oil-based fluid (e.g., hydrocarbon fluid, oil fluid, oleaginous fluid, terpene fluid, diesel, gasoline, xylene, octane, hexane, etc.), or combinations thereof. A commercial nonlimiting example of an oil-based fluid includes EDC 95-11 drilling fluid.

In an embodiment, the swellable material may comprise a water-swellable material, an oil-swellable material, a water-and-oil-swellable material, or combinations thereof. As will be appreciated by one of skill in the art, and with the help of this disclosure, the water-swellable materials may swell when contacted with a swelling agent comprising a water-based fluid; the oil-swellable materials may swell when contacted with a swelling agent comprising an oil-based fluid; and the water-and-oil-swellable materials may swell when contacted with a swelling agent comprising a water-based fluid, an oil-based fluid, or both a water-based fluid and an oil-based fluid. As will be appreciated by one of skill in the art, and with the help of this disclosure, a water-swellable material might exhibit some degree of oil-swellability (e.g., swelling when contacted with an oil-based fluid). Similarly, as will be appreciated by one of skill in the art, and with the help of this disclosure, an oil-swellable material might exhibit some degree of water-swellability (e.g., swelling when contacted with a water-based fluid).

Nonlimititng examples of water-swellable materials suitable for use in the present disclosure include a tetrafluoroethylene/propylene copolymer (TFE/P), a starch-polyacrylate acid graft copolymer, a polyvinyl alcohol/cyclic acid anhydride graft copolymer, an isobutylene/maleic anhydride copolymer, a vinyl acetate/acrylate copolymer, a polyethylene oxide polymer, graft-poly(ethylene oxide) of poly (acrylic acid), a carboxymethyl cellulose type polymer, a starch-polyacrylonitrile graft copolymer, polymethacrylate, polyacrylamide, an acrylamide/acrylic acid copolymer, poly (2-hydroxyethyl methacrylate), poly(2-hydroxypropyl methacrylate), a non-soluble acrylic polymer, a highly swelling clay mineral, sodium bentonite (e.g., sodium bentonite having as main ingredient montmorillonite), calcium bentonite, and the like, derivatives thereof, or combinations thereof.

Nonlimiting examples of oil-swellable materials suitable for use in the present disclosure include an oil-swellable rubber, a natural rubber, a polyurethane rubber, an acrylate/butadiene rubber, a butyl rubber (IIR), a brominated butyl rubber (BUR), a chlorinated butyl rubber (CIIR), a chlorinated polyethylene rubber (CM/CPE), an isoprene rubber, a chloroprene rubber, a neoprene rubber, a butadiene rubber, a styrene/butadiene copolymer rubber (SBR), a sulphonated polyethylene (PES), chlor-sulphonated polyethylene (CSM), an ethylene/acrylate rubber (EAM, AEM), an epichlorohydrin/ethylene oxide copolymer rubber (CO, ECO), an ethylene/propylene copolymer rubber (EPM), ethylene/propylene/diene terpolymer (EPDM), a peroxide crosslinked ethylene/propylene copolymer rubber, a sulphur crosslinked ethylene/propylene copolymer rubber, an ethylene/propylene/diene terpolymer rubber (EPT), an ethylene/vinyl acetate copolymer, a fluoro silicone rubber (FVMQ), a silicone rubber (VMQ), a poly 2,2,1-bicyclo heptene (polynorbornene), an alkylstyrene polymer, a crosslinked substituted vinyl/acrylate copolymer, and the like, derivatives thereof, or combinations thereof.

Nonlimititng examples of water-and-oil-swellable materials suitable for use in the present disclosure include a nitrile rubber (NBR), an acrylonitrile/butadiene rubber, a hydrogenated nitrile rubber (HNBR), a highly saturated nitrile rubber (HNS), a hydrogenated acrylonitrile/butadiene rubber, an acrylic acid type polymer, poly(acrylic acid), polyacrylate rubber, a fluoro rubber (FKM), a perfluoro rubber (FFKM), and the like, derivatives thereof, or combinations thereof.

In an embodiment, a water-swellable material with a varying degree of low oil-swellability may be obtained by adding to an EPDM polymer or its precursor monomer mixture of (i) elastomer additive, such as for example nitrile, HNBR, fluoroelastomers, or acrylate-based elastomers, or their precursors; and (ii) an unsaturated organic acid, anhydride, or derivatives thereof (e.g., maleic acid, 2-acrylamido-2-methylpropane sulfonic acid), optionally combined with an inorganic expanding agent (e.g., sodium carbonate); wherein the unsaturated organic acid, anhydride, or derivatives thereof may be present within the EPDM polymer or its precursor monomer mixture in an amount of from about 1 to about 10 per hundred rubber (phr), and wherein the inorganic expanding agent may be present within the EPDM polymer or its precursor monomer mixture in an amount of from about 1 to about 10 phr.

In an embodiment, the unsaturated organic acid comprises a highly acidic unsaturated compound (e.g., 2-acrylamido-2-methylpropane sulfonic acid). In such embodiment, when the highly acidic unsaturated compound is added to the EPDM polymer or its precursor monomer mixture in an amount of from about 0.5 to about 5 phr, the resulting swellable material may have a variable oil-swellability, and may be further swellable in low pH fluids, such as for example completion fluids containing zinc bromide.

In an embodiment, a second addition of an additional amount of an inorganic expanding agent (e.g., an additional amount of from about 1 to about 10 phr) to the EPDM polymer or its precursor monomer mixture may enhance the swellability of the swellable material in low pH, high concentration brines.

In an embodiment, a zwitterionic polymer or copolymer of a zwitterionic monomer with an unsaturated monomer may be added to the EPDM polymer or its precursor monomer mixture to obtain a crosslinked swellable material.

As will be appreciated by one of skill in the art, and with the help of this disclosure, the amounts of the various ingredients used for producing or obtaining a polymeric swellable material may be varied as suited for the particular purpose at hand. For example, if the desired swellable material is a highly crosslinked, moderately water-swellable (e.g., about 150% swell by volume) elastomer having very low oil-swellability, but very high swellability in low pH fluids, the recipe might include, by way of example and not of limitation, from about 60 to about 80 phr of EPDM; from about 20 to about 40 phr of nitrile or HNBR; from about 4 to about 5 phr of 2-acrylamido-2-methylpropane sulfonic acid; and from about 15 to about 20 phr of a zwitterionic polymer or monomer.

Other swellable materials that behave in a similar fashion with respect to oil-based fluids and/or water-based fluids may also be suitable. Those of ordinary skill in the art, with the benefit of this disclosure, will be able to select an appropriate swellable material for use in the compositions of the present invention based on a variety of factors, including the application in which the composition will be used and the desired swelling characteristics. Suitable swellable materials are commercially available as one or more components of SWELLPACKERS zonal isolation system from Halliburton Energy Services, Inc.

In an embodiment, the swellable materials suitable for use in this disclosure comprise swellable material particles of any suitable geometry, including without limitation beads, hollow beads, spheres, ovals, fibers, rods, pellets, platelets, disks, plates, ribbons, and the like, or combinations thereof. In an embodiment, the swellable material may be characterized by a particle size of from about 0.1 microns to about 2000 microns, alternatively from about 0.5 microns to about 1500 microns, or alternatively from about 1 microns to about 1000 microns.

Nonlimiting examples of swellable materials suitable for use in conjunction with the methods of this disclosure are described in more detail in U.S. Pat. Nos. 3,385,367; 7,059,415; 7,143,832; 7,717,180; 7,934,554; 8,042,618; and 8,100,190; each of which is incorporated by reference herein in its entirety.

In the embodiment of FIG. 2, the jacket 230 generally covers at least a portion of an outer surface 221 of the sealing element 220. The jacket 230 may be at least substantially impermeable to a swelling agent that is configured to cause the sealing element 220 to swell. In an embodiment, the jacket 230 may be generally configured to control a swell-rate of the sealing element 220 (e.g., swell-rate of the swellable material), wherein the swellable material of the sealing element 220 may swell (e.g., expand or increase in volume) upon sufficient contact between the CSSP and the swelling agent. For purposes of the disclosure herein, the swell-rate of a material (e.g., sealing element 220, swellable material) is defined as the ratio between the volume expansion or increase of such material and the time or duration required for such volume expansion to occur; wherein the volume expansion represents the difference between a final volume assessed at the end of the evaluated time period and an initial volume assessed at the beginning of the evaluated time period. As will be appreciated by one of skill in the art, and with the help of this disclosure, the swell-rate of the sealing element 220 and the swell-rate of the swellable material as part of the sealing element are about the same, although the swell-rate of the swellable material assessed outside of a CSSP (i.e., when the swellable material is not part of the CSSP) might be different than the swell-rate of the sealing element 220. Without wishing to be limited by theory, the jacket 230 may control the swell-rate by limiting the exposure of the swellable material (e.g., the sealing element 220) to the swelling agent. Further, without wishing to be limited by theory, contact between the swelling agent and the sealing element, and consequently the swelling of the swellable material, may be dependent upon the geometry and composition of the jacket which controls fluidic access of the swelling agent to the sealing element as described in more detail herein.

In an embodiment, the jacket 230 may cover a suitable portion of the outer surface 221 of the sealing element 220, that is, a portion of the outer surface 221 of the sealing element 220 that would be exposed (e.g., so as to be in direct contact with a swelling agent, when such swelling agent is present), were the jacket 230 not present. In an embodiment, the jacket 230 may cover equal to or greater than about 75%, alternatively about 80%, alternatively about 81%, alternatively about 82%, alternatively about 83%, alternatively about 84%, alternatively about 85%, alternatively about 86%, alternatively about 87%, alternatively about 88%, alternatively about 89%, alternatively about 90%, alternatively about 91%, alternatively about 92%, alternatively about 93%, alternatively about 94%, or alternatively about 95% of the outer surface area of the sealing element 220.

In an embodiment, the jacket 230 provides at least a substantially fluid tight seal to the portion of the outer surface 221 of the sealing element 220 that it covers. For example, teh jacket 230 may serve to prevent and/or limit direct contact between a fluid (e.g., a swelling agent) and the portion of the outer surface 221 of the sealing element 220 that is covered by the jacket 230. In some embodiments, the substantially fluid tight seal provided by the jacket 230 may be provided when the jacket 230 comprises a diffusional flow rate of the swelling agent that is substantially less than the diffusional flow rate into the exposed portions of the sealing element 220. For example, the ratio of the diffusional flow rate of the swelling agent through the jacket 230 to the diffusional flow rate into the exposed portions of the sealing element 220 may be at least about 1:10 to about 1:100. In an embodiment, the jacket 230 may be impervious or impermeable with respect to the swelling agent. In an embodiment, the jacket 230 may be substantially impervious or impermeable with respect to the swelling agent. In an embodiment, the jacket 230 may have a low permeability with respect to the swelling agent. In an embodiment, the jacket 230 may allow less than about 20%, alternatively less than about 15%, alternatively less than about 10%, alternatively less than about 9%, alternatively less than about 8%, alternatively less than about 7%, alternatively less than about 6%, alternatively less than about 5%, alternatively less than about 4%, alternatively less than about 3%, alternatively less than about 2%, alternatively less than about 1%, alternatively less than about 0.1%, alternatively less than about 0.01%, or alternatively less than about 0.001% of the outer surface area 221 that is sealingly covered by the jacket 230 to be in direct contact with a swelling agent.

In an embodiment, the jacket 230 may comprise one or more coating layers. For purposes of the disclosure herein, a coating layer of the jacket will be understood to be a coating layer of the jacket that was applied onto the sealing element 220 in a single coating or application procedure. For example, a jacket 230 may comprise one coating layer of material A that has been applied in a single coating procedure. Alternatively, a jacket 230 may comprise two coating layers of material A, wherein material A has been applied onto to the sealing element 220 in two distinct coating procedures (e.g., each coating layer has been applied at a different time). In some embodiments, a jacket 230 may comprise one coating layer of material A and one coating layer of material B, wherein the coating layer of material A and the coating layer of material B have each been applied onto to the sealing element 220 in two distinct coating procedures (each coating layer has been applied at a different time). In still other embodiments, a jacket 230 may comprise one coating layer of both material A and material B, wherein both material A and material B have been applied concomitantly (e.g., at the same time) onto to the sealing element 220.

In an embodiment, the jacket 230 may comprise at least two coating layers, alternatively at least three coating layers, alternatively at least four coating layers, or alternatively at least five or more coating layers. For purposes of the disclosure herein, when the jacket 230 is made up of two or more coating layers, the first coating layer applied directly onto the sealing element 220 will be referred to as the "primer coating layer," and any coating layer or layers applied subsequent to the primer coating layer will be referred to as a "top coating layer" or "top coating layers." Further, for purposes of the disclosure herein, the top coating layer applied after the primer coating layer will be referred to as a "first top coating layer;" the top coating layer applied after the first top coating layer will be referred to as a "second top coating layer;" the top coating layer applied after the second top coating layer will be referred to as a "third top coating layer;" the top coating layer applied after the third top coating layer will be referred to as a "fourth top coating layer;" and so on. As will be appreciated by one of skill in the art, and with the help of this disclosure, the first top coating layer will be closest to the sealing element out of any applied top coating layers, the second top coating layer will be the second closest to the sealing element after the first top coating layer, and so on.

In an embodiment, the primer coating layer may function to activate the outer surface 221 of the sealing element 220, e.g., enable or promote adherence between the sealing element 220 and the top coating layer or layers. The primer coating is optional and may not be present in some embodiments. For example, the primer coating layer may not be present when the coating material sufficiently adheres to the outer surface 221 of the sealing element 220. Without wishing to be limited by theory, the primer coating layer may activate the outer surface 221 of the sealing element 220 by adhering to the sealing element, and then adhering to the top coating layer(s). The primer coating layer can be regarded as a "glue" between the sealing element 220 and the top coating layer(s) of the jacket. As will be appreciated by one of skill in the art, and with the help of this disclosure, the primer coating layer may be useful when the top coating layer(s) of the jacket 230 would not adhere to the sealing element 220 such as to form a fluid tight seal, and the primer coating layer may be selected such as to form a fluid tight seal with both the sealing element 220 and the top coating layer(s).

In an embodiment, the primer coating layer comprises a water-based primer. In an alternative embodiment, the primer coating layer comprises an organic solvent-based primer. A nonlimiting example of a water-based primers suitable for use in the present disclosure includes a two component system, wherein a first component (e.g., base) comprises epoxy constituents and $C_{13}$-$C_{15}$ alkyl glycidyl ether, and a second component (e.g., activator) comprises tetraethylenepentamine. Nonlimiting examples of organic solvent-based primers suitable for use in the present disclosure include urethane, an isocyanate-based adhesive, and the like.

In an embodiment, the primer coating layer may be characterized by a thickness of less than about 10 microns, alternatively less than about 5 microns, or alternatively less than about 1 micron.

In some embodiments, the outer surface 221 of the sealing element 220 may be activated (e.g., to enable or promote adherence between the sealing element 220 and the top coating layer or layers) by flame treatments, plasma treatments, electron beam treatments, oxidation treatments, corona discharge treatments, hot air treatments, ozone treatments, ultraviolet light treatments, sand blast treatments, and the like, or any combination thereof.

In an embodiment, the top coating layer(s) may comprise a coating material that is impervious or impermeable with respect to the swelling agent. In an embodiment, the top coating layer(s) may comprise a coating material that is substantially impervious or impermeable with respect to the swelling agent. In an embodiment, the top coating layer(s) may comprise a coating material that has a low permeability with respect to the swelling agent.

In an embodiment, the top coating layer(s) may comprise a flexible coating material. For purposes of the disclosure herein, a flexible coating material may be defined as a coating material that stretches as the sealing element swells or expands in volume, without losing sealing contact with the outer surface 221 of the sealing element 220. Without wishing to be limited by theory, the flexible coating material may stretch at the same rate at which the outer surface of the sealing element 220 increases or expands. Further, without wishing to be limited by theory, the ratio between the outer surface area of the sealing element 220 in sealing contact with the jacket and the surface area of the jacket 230 remains substantially the same throughout the swelling process, e.g., about 1:1, when the top coating layer comprises a flexible coating material. In other embodiments, the top coating layer(s) may comprise a partially flexible coating material. Without wishing to be limited by theory, the ratio between the outer surface area of the sealing element 220 in sealing contact with the jacket 230 and the surface area of the jacket 230 may vary during the swelling process, when the top coating layer comprises a partially flexible coating material.

Nonlimiting examples of coating materials suitable for use with the jacket 230 may comprise plastics, polymeric materials, polyethylene, polypropylene, fluoro-elastomers, fluoro-polymers, fluoropolymer elastomers, polytetrafluoroethylene, a tetrafluoroethylene/propylene copolymer (TFE/P), polyamide-imide (PAI), polyimide, polyphenylene sulfide (PPS), or combinations thereof. In an embodiment, the coating material comprises a water-based coating material. In an alternative embodiment, the coating material comprises an organic solvent-based coating material. In an embodiment, the coating material comprises a one-component system. In an alternative embodiment, the coating material comprises a multi-component system (e.g., a two-component system, a three-component system, etc.), wherein the multi-component system may undergo a cross-linking process during the drying/curing/hardening of the top layer(s). In an embodiment, the top coating layer(s) may comprise a flexible binder system and a protective filler. As will be appreciated by one of skill in the art, and with the help of this disclosure, a material that is a water-swellable material may be used as a top coating layer for an oil-swellable material that is designed to swell upon contact with a swelling agent comprising an oil-based fluid. Similarly, as will be appreciated by one of skill in the art, and with the help of this disclosure, a material that is an oil-swellable material may be used as a top coating layer for a water-swellable material that is designed to swell upon contact with a swelling agent comprising a water-based fluid.

Nonlimiting examples of commercially available coating materials suitable to form the jacket 230 (e.g., a top coating layer) include ACCOLAN, ACCOAT, and ACCOFLEX, all of which are available from Accoat, located in Kvistgaard, Denmark; VITON which is a fluoropolymer elastomer available from DuPont; AFLAS which is a TFE/P available from Asahi Glass Co., LTD.; and VESPEL which is a polyimide available from DuPont. Other suitable coating materials may be appreciated by persons of skill in the art, and with the help of this disclosure.

In an embodiment, the top coating layer may be characterized by a thickness of from about 10 microns to about 100 microns, alternatively from about 30 microns to about 60 microns, or alternatively from about 35 microns to about 55 microns.

In an embodiment, some swellable materials might leach out (e.g., bleed, leak, come out, seep out, etc.) of the sealing element 220 over time. In such an embodiment, the swellable materials could leach out the sealing element 220 through the exposed outer surface (e.g., the portions of the outer surface not covered by the jacket 230). Consequently, over time, a CSSP like CSSP 220 might lose the ability to isolate two or more adjacent portions or zones within a subterranean formation (e.g., subterranean formation 102) and/or wellbore (e.g., wellbore 114).

In an embodiment, CSSP 200 may comprise an optional retention coating layer. In such embodiment, the retention coating layer would prevent the outflow of swelling material from the sealing element 220 and would allow the inflow of the swelling agent, such that the swelling agent would contact the swellable material. In an embodiment, the retention coating layer may cover about 100%, alternatively about 99%, alternatively about 98%, alternatively about 97%, or alternatively about 96% of the outer surface area 221 of the sealing element 220 and/or the exposed surface area of the sealing element (e.g., the portion not covered by the jacket 230). As will be appreciated by one of skill in the art, and with the help of this disclosure, when a retention coating layer is used, the jacket will be in sealing contact (e.g., a fluid tight seal) with the retention coating layer, and as such the inflow of swelling agent into the sealing element 220 may occur through the retention coating layer present on the exposed outer surface (e.g., the outer surface portions not in sealing contact with the jacket 230). Further, as will be appreciated by one of skill in the art, and with the help of this disclosure, the jacket 230 will prevent the outflow of swelling material from the sealing element 220 through the portions of the outer surface covered by the jacket 230. In an embodiment, the retention coating layer comprises a flexible retention coating material.

In an alternative embodiment, CSSP 200 may comprise an optional retention coating layer atop both the jacket 230 and the exposed portions of the outer surface (e.g., the portions of the outer surface not covered by the jacket 230). As will be appreciated by one of skill in the art, and with the help of this disclosure, such retention coating layer may be applied onto an outer surface of the CSSP 200 (e.g., an outer surface of the sealing element 220) after the removal of a mask used to create the exposed portions of the outer surface (e.g., the portions of the outer surface not covered by the jacket 230), as will be described later herein. Other suitable configurations for the retention coating layer will be appreciated by one of skill in the art, and with the help of this disclosure.

In an embodiment, the retention coating material may comprise a water permeable or a water semi-permeable polymeric material, such as for example a sulfonated tetrafluoroethylene based fluoropolymer-copolymer, polyetheretherketone (PEEK), polyetherketone (PEK), and the like. As will be appreciated by one of skill in the art, and with the help of this disclosure, the water permeable polymeric material would allow the inflow of water and/or water-based swelling agent fluids, while preventing the outflow of the swellable materials.

In an embodiment, the retention layer may be characterized by a thickness of from about 1 microns to about 100 microns, alternatively from about 5 microns to about 75 microns, or alternatively from about 10 microns to about 50 microns.

In an embodiment, the jacket 230 (e.g., the material comprising the jacket 230, such as for example the water-based primer, organic solvent-based primer, coating material, etc.) and/or the retention coating layer, or any layers thereof may be configured to be applied to the sealing element 220 by any suitable process. For example, in various embodiments, the jacket 230 and/or the retention coating layer, or any layers thereof may comprise a liquideous or substantially liquideous material that may be sprayed onto the sealing element 220, painted onto the sealing element 220, into which the sealing element 220 may be dipped, or the like. In an embodiment, the material comprising the jacket 230 may be configured to dry (e.g., set, set up, set in place, cure, harden, crosslink, or the like) upon exposure to a predetermined condition or upon passage of a given duration of time. For example, the jacket 230 and/or the retention coating layer, or any layers thereof may dry (or the like) upon being heated, cooled, exposed to a hardening chemical, or combinations thereof.

Figure 3:
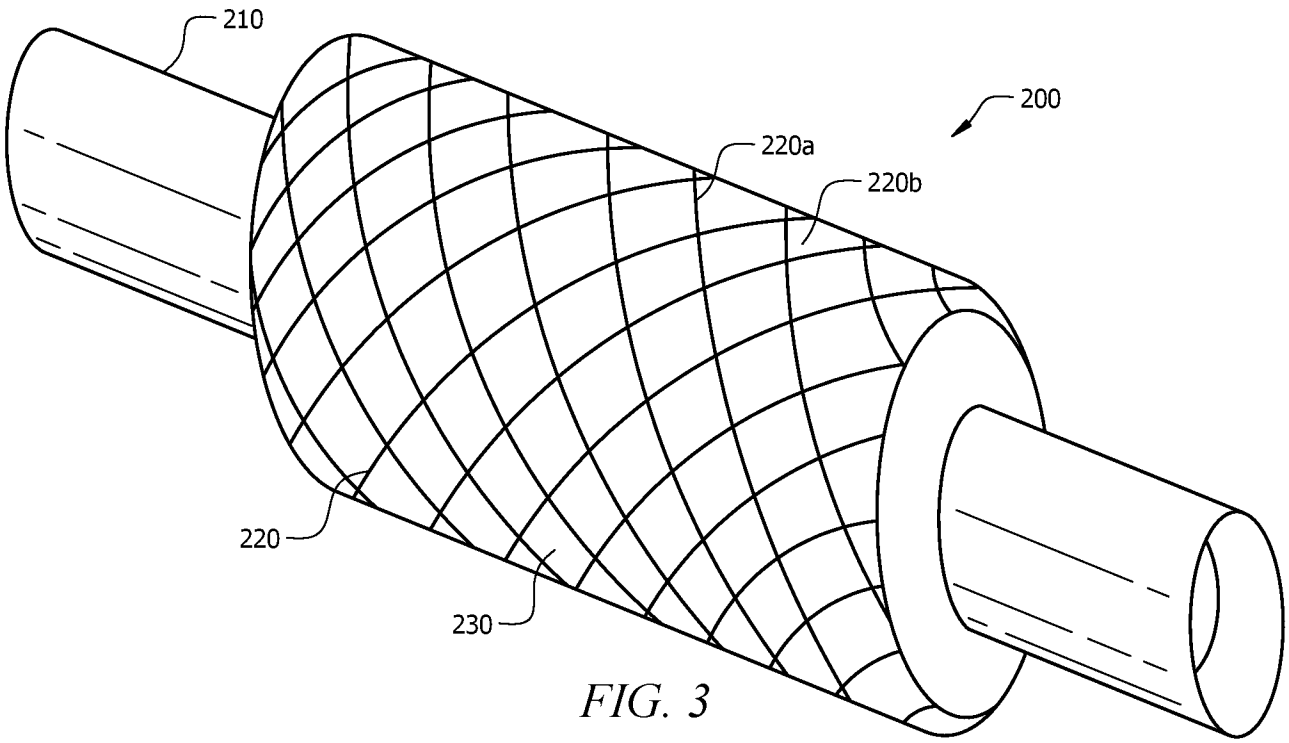
FIG. 3 is an isometric view of an embodiment of a controlled swell-rate swellable packer.

As previously disclosed herein, the jacket 230 may be applied to only a portion of the outer surface of the sealing element 220, for example, thereby yielding an exposed outer surface portion (e.g., to which the jacket 230 material is not applied) and an unexposed outer surface portion (e.g., to which the jacket 230 material is applied). For example, referring to the embodiment of FIG. 3, a perspective view of a CSSP 200 is illustrated. In the embodiment of FIG. 3, a portion of the sealing element 220 is exposed (e.g., an exposed portion 220*a*) and another portion is covered by the jacket 230 (e.g., an unexposed portion 220*b*). In an embodiment, the relationship between the exposed and unexposed portions may comprise any suitable pattern, design, or the like. In an embodiment, the exposed portion 220*a* may optionally comprise a retention coating layer, as previously described herein.

In an embodiment, as will be disclosed herein, the exposed and unexposed surfaces of the sealing element 220 may be obtained by "masking" or otherwise covering a portion of the outer surface 221 of the sealing element 220 (e.g., the portion of the outer surface 221 of the sealing element 220 which will be exposed) prior to application of the jacket 230 material. In an embodiment, such a "mask" may be configured to cover any suitable portion of the outer surface 221 of the sealing element 220. For example, in an embodiment, the mask may comprise a grid-like pattern, a diamond pattern, a pattern of vertical, horizontal, and/or helical strips, a random arrangement, etc. The pattern of the mask may also provide for any variety of opening shapes and sizes for a given surface area coverage. For example, the mask may provide a few relatively large openings or a greater number of smaller openings. The openings or open areas can have any shape such as a round shape (circular, oval, elliptical, etc.), a square or rectangular shape, linear shape (e.g., vertical, horizontal, and/or helical stripes, etc.), or any other suitable shape. The mask may be made from any suitable material, examples of which include, but are not limited to, paper, plastic, wires, metals, various fibrous materials, thread, rope, net, or combinations thereof.

One or more embodiments of a CSSP, such as CSSP 200 disclosed herein, having been disclosed, one or more methods related to making/assembling and utilizing such a CSSP are also disclosed herein.

In an embodiment, a method of making a CSSP, such as CSSP 200, generally comprises the steps of providing a mandrel (e.g., mandrel 210 disclosed herein) having at least one sealing element (e.g., sealing element 220 disclosed herein) disposed about at least a portion thereof, masking at least a portion of the outer surface of the sealing element, applying a jacket (e.g., jacket 230 disclosed herein) to the sealing element in one or more layers, and removing the mask.

In an embodiment, the mandrel 210 having at least one sealing element 220 disposed about at least a portion thereof may be obtained. For example, suitable mandrels 210 and sealing elements 220 may be obtained, alone or in combination, from Halliburton Energy Services, Inc.

Figure 4:
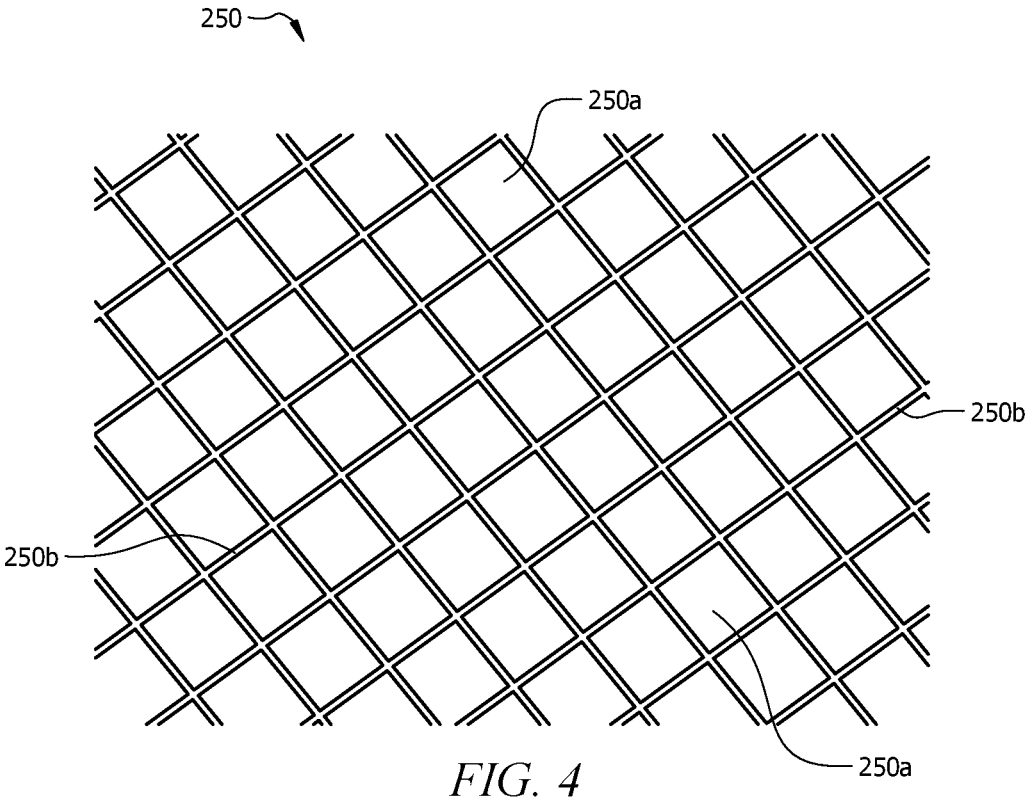
FIG. 4 is a schematic representation of an embodiment of a mask.

In an embodiment, once a mandrel 210 having a sealing element 220 disposed there-around is obtained, at least a portion of the sealing element 220 (e.g., at least a portion of the outer surface 221 of the sealing element 220) may be covered with a mask. In an embodiment, such a mask may be preformed in any suitable shape. An example of a suitable mask 250 is illustrated in FIG. 4, although one of skill in the art, upon viewing this disclosure, will appreciate other suitable configurations. In the embodiment of FIG. 4, the mask 250 comprises a grid-like pattern 250*b* having a plurality of void spaces 250*a*. In alternative embodiments, a mask may be any suitable configuration. For example, the mask may comprise a substantially uniform pattern; alternatively, the mask may have no pattern at all. In an embodiment, the mask 250 may comprise a single sheet (e.g., as shown in FIG. 4). In an alternative embodiment, the mask may comprise multiple sheets, ribbons, wires, or other suitable forms. In an embodiment, the mask may be wrapped around (e.g., applied onto) the sealing element and secured in place prior to applying the jacket or any layers thereof.

In an embodiment, once the mask (e.g., mask 250) has been secured to/around the sealing element 220, the jacket 230 or any layers thereof may be applied to the masked sealing element 220. For example, the material comprising the jacket 230 (e.g., water-based primer, organic solvent-based primer, coating material, etc.) or any layers thereof may be sprayed onto the masked sealing element 220; alternatively, the material comprising the jacket 230 (e.g., water-based primer, organic solvent-based primer, coating material, etc.) or any layers thereof may be painted or brushed onto the masked sealing element 220; alternatively, the masked sealing element 220 may be dipped, rolled, or submerged within the material comprising the jacket 230 (e.g., water-based primer, organic solvent-based primer, coating material, etc.) or any layers thereof. As the masked sealing element 220 is coated with the material which will form the jacket 230 (e.g., water-based primer, organic solvent-based primer, coating material, etc.) or any layers thereof, the material of the jacket 230 (e.g., water-based primer, organic solvent-based primer, coating material, etc.) or any layers thereof may adhere to the portions of the sealing element 220 not covered or shrouded by the mask 250.

In an embodiment, the material of the jacket 230 or any layers thereof may be allowed to dry (e.g., set, set up, set in place, cure, harden, crosslink, or the like) prior to removing the mask 250 and/or prior to applying another layer (e.g. a top coating layer). In an alternative embodiment, the mask 250 may be removed at any suitable time after the material of jacket 230 or any layers thereof has been applied thereto. In an embodiment, after the mask 250 is removed, a portion of the sealing element 220 a portion of the sealing element 220 is exposed (an exposed portion 220*a*) and another portion is covered by the jacket 230 (an unexposed portion 220*b*) or any layers thereof, as previously disclosed herein. In an embodiment, when the jacket 230 comprises more than one layer, a layer applied onto the masked sealing element 220 may be allowed to dry prior to the application of another layer; alternatively, subsequent layers may be applied onto a layer without allowing an already applied layer to dry.

One or more of embodiments of a CSSP like CSSP 200 having been disclosed, one or more embodiments of a wellbore servicing method employing such a CSSP are also disclosed herein. In an embodiment, a method of utilizing a CSSP, such as CSSP 200 disclosed herein, generally comprises the steps of providing a CSSP 200, disposing a tubular string having a CSSP 200 incorporated therein within a wellbore, and activating the CSSP 200. Additionally, in an embodiment, the method may further comprise performing a wellbore servicing operation, producing a reservoir fluid, or combinations thereof.

In an embodiment, providing a CSSP 200 may comprise one or more of the steps of the method of making the CSSP 200, as disclosed herein. In an embodiment, once a CSSP 200 has been obtained (e.g., either manufactured or obtained from a manufacturer), the CSSP 200 may be utilized as disclosed herein.

In an embodiment, the CSSP 200 may be incorporated within a tubular string (e.g., a casing string like casing string 120, a work string, a tool string, a segmented tubing string, a jointed pipe string, a coiled tubing string, a production tubing string, a drill string, the like, or any other suitable wellbore tubular) and disposed within a wellbore (e.g., wellbore 114). Additionally, for example, as disclosed with regard to FIG. 1, in an embodiment, a tubular string may comprise one, two, three, four, five, six, seven, eight, nine, ten, or more CSSPs incorporated therein.

In an embodiment, the CSSP(s) 200 (e.g., the first, second, third, and fourth CSSPs 200*a*, 200*b*, 200*c*, and 200*d*, respectively) may be incorporated into the tubular string as the tubular string is "run into" the wellbore (e.g., wellbore 114). For example, as will be appreciated by one of skill in the art upon viewing this disclosure, such tubular strings are conventionally assembled in "joints" which are added to the uppermost end of the string (e.g., a tubular string) as the string is run in. The tubular string (e.g., casing string 120) may be assembled and run into the wellbore 114 until the CSSP(s) are located at a predetermined location, for example, such that a given CSSP (when expanded) will isolate (e.g., prevent fluid flow between) two adjacent zones of the subterranean formation 102 (e.g., formation zones 2, 4, 6, and 8) and/or portions of the wellbore 114. Referring to the embodiment of FIG. 1, CSSP 200*a*, when expanded, may isolate zones 2 and 4 from each other; CSSP 200*b*, when expanded, may isolate zones 4 and 6 from each other; CSSP 200*c*, when expanded, may isolate zones 6 and 8 from each other; etc.

In an embodiment, once the tubular string (e.g., casing string 120) comprising one or more CSSPs (e.g., CSSP 200, CSSP 200*a*, CSSP 200*b*, CSSP 200*c*, CSSP 200*d*) is positioned within the wellbore (e.g., wellbore 114), for example, such that the CSSPs will isolated two adjacent zones of the subterranean formation 102 and/or portions of the wellbore 114 when expanded, the CSSPs may be activated, i.e., caused to expand. In an embodiment, activating the CSSP may comprise contacting the CSSP with the swelling agent. As previously described herein, the swelling agent may comprise any suitable fluid, such as for example, a water-based fluid (e.g., aqueous solutions, water, etc.), an oil-based fluid (e.g., hydrocarbon fluid, oil fluid, oleaginous fluid, etc.), or combinations thereof. In an embodiment, the swelling agent may comprise a fluid already present within the wellbore 114, for example, a servicing fluid, a formation fluid (e.g., a hydrocarbon fluid), or combinations thereof. Alternatively, the swelling agent may be introduced into the wellbore 114, e.g., as a servicing fluid. The swelling agent may be allowed to remain in contact with the CSSP (e.g., with the exposed portions 220*a* of the sealing element 220) for a sufficient amount of time for the sealing element to expand into contact with the subterranean formation (e.g., with the walls of the wellbore 114), for example, at least 2 days, alternatively at least 4 days, alternatively at least 8 days, alternatively at least 12 days, alternatively at least 2 weeks, alternatively at least 1 month, alternatively at least 2 months, alternatively at least 3 months, alternatively at least 4 months, or alternatively any suitable duration.

In an embodiment, contact with the swelling agent may cause the sealing element (e.g., sealing element 220) to expand into contact with the subterranean formation (e.g., with the walls of the wellbore 114). In such an embodiment, the expansion of the sealing element (e.g., sealing element 220) may be effective to isolate two or more portions of an annular space extending generally between the tubing string (e.g., casing string 120) and the walls of the wellbore (e.g., wellbore 114). In an embodiment, the expansion of the sealing element (e.g., sealing element 220) may occur at a controlled rate (e.g., controlled swell-rate), as disclosed herein. Without wishing to be limited by theory, the swelling agent might exhibit lateral/sideways diffusion of the swelling agent under the jacket (i.e., under the portions of the outer surface sealingly covered by the jacket), along with radial diffusion (e.g., diffusion of the swelling agent towards the mandrel 210). In an embodiment, the expansion of the sealing element 220 (e.g., where the sealing element continues to expand) may occur over a predetermined duration, for example, about 4 days, alternatively about 6 days, alternatively about 8 days, alternatively about 10 days, alternatively about 12 days, alternatively about 14 days, alternatively about 16 days, alternatively about 18 days, alternatively about 20 days, alternatively about 22 days, or alternatively about 24 days.

In some embodiments, the swell-rate of the sealing element may have a linear shape throughout the swelling process. In such embodiments, the top layer coating may comprise a flexible coating material. For example, a flexible coating material would stretch and stay in sealing contact with the sealing element, thus leading to an uniform swelling of the sealing element, i.e., an approximately linear swell-rate.

In other embodiments, the swell-rate of the sealing element may have an overall non-linear shape throughout the swelling process, e.g., a non-linear swell-rate. In an embodiment, the top layer coating may comprise a partially flexible coating material. For example, the swell-rate of the sealing element could have an initial linear portion corresponding to a first swell-rate characterized by an initial swelling period when the partially flexible coating material would stretch and stay in sealing contact with the sealing element. The linear swell-rate may then be followed by a rapid increase in the swell-rate (e.g., a linear increase in swell-rate with a steeper slope than the initial slope; an exponential increase in the swell-rate; etc.) corresponding to a second swell-rate owing to an inability of the partially flexible coating material to stretch further, causing the partially flexible coating material to separate (e.g., come off, peel off) from the sealing element either partially or completely. As a result, a much larger portion of the outer surface of the sealing element may be exposed to the swelling agent. In such embodiments, the second swell-rate may be larger than the first swell-rate. In an embodiment, the first swell-rate may last over a predetermined duration, for example, about 2 days, alternatively about 4 days, alternatively about 6 days, alternatively about 8 days, alternatively about 10 days, alternatively about 12 days, alternatively about 14 days, alternatively about 16 days, alternatively about 18 days, alternatively about 20 days, or alternatively about 22 days. In an embodiment, the second swell-rate may last over a predetermined duration, for example, about 2 days, alternatively about 4 days, alternatively about 6 days, alternatively about 8 days, alternatively about 10 days, alternatively about 12 days, alternatively about 14 days, alternatively about 16 days, alternatively about 18 days, alternatively about 20 days, or alternatively about 22 days.

In an embodiment, following at least partial expansion of the CSSP(s), for example, such that two or more portions of the wellbore (e.g., wellbore 114) and/or two or more zones (e.g., zones 2, 4, 6 and/or 8) of the subterranean formation (e.g., subterranean formation 102) are substantially isolated, a wellbore servicing operation may be performed with respect to one or more of such formation zones. In such an embodiment, the wellbore servicing operation may include any suitable servicing operation as will be appreciated by one of skill in the art upon viewing this disclosure. Examples of such wellbore servicing operations include, but are not limited to, a fracturing operation, a perforating operation, an acidizing operation, or combinations thereof.

In an embodiment, following at least partial expansion of the CSSP(s), for example, such that two or more portions of the wellbore (e.g., wellbore 114) and/or two or more zones (e.g., zones 2, 4, 6 and/or 8) of the subterranean formation (e.g., subterranean formation 102) are substantially isolated and, optionally, following the performance of a wellbore servicing operation, a formation fluid (e.g., oil, gas, or both) may be produced from the subterranean formation (e.g., subterranean formation 102) or one or more zones (e.g., zones 2, 4, 6 and/or 8) thereof.

In an embodiment, a wellbore servicing system and/or apparatus comprising a controlled swell-rate swellable packer such as a CSSP 200, a wellbore servicing method employing such a wellbore servicing system and/or apparatus comprising a controlled swell-rate swellable packer (CSSP) such as a CSSP 200, or combinations thereof may be advantageously employed in the performance of a wellbore servicing operation. For example, a controlled swell-rate swellable packer (CSSP) such as a CSSP 200 may allow for a selective and controlled swelling profile of such packer. The ability to control the swell-rate and consequently the swelling profile may improve the accuracy of placing and activating a controlled swell-rate swellable packer such as a CSSP 200, such that two or more portions of the wellbore and/or two or more zones of the subterranean formation are substantially isolated.

The use of a jacket comprising a material that is substantially impermeable to a fluid configured to cause the sealing element to swell may allow for a variety of swelling patterns to be provided by the CSSP. For example, when the swell rate is controlled by the exposed surface area of the sealing element, the amount of the exposed area can be controlled during the CSSP manufacturing process. This may present an advantage relative to swellable packers utilizing a sealing element composition or semi-permeable layer thickness to control the swelling rate, where the composition and semi-permeable layer thickness can vary somewhat during the manufacturing process. Further, the use of a variety of patterns of the jacket can provide varying swelling characteristics (e.g., linear swelling rates, non-linear swelling rates, and various combinations thereof).

In an embodiment, the swell-rate of a CSSP may be advantageously controlled (e.g., modulated) by varying the type and/or composition of the swelling material; the type and/or composition of the jacket; the number of layers in the jacket; the pattern of the mask; the ratio between the portion of the outer surface of the sealing element exposed to the swelling agent and the portion of the outer surface of the sealing element cover by the jacket; the type and/or composition of the swelling agent; or combinations thereof. As will be appreciated by one of skill in the art, and with the help of this disclosure, the larger the ratio between the portion of the outer surface of the sealing element exposed to the swelling agent and the portion of the outer surface of the sealing element covered by the jacket, the higher the value of the swell-rate (e.g., the sealing element will swell faster or at a faster rate). Similarly, as will be appreciated by one of skill in the art, and with the help of this disclosure, the smaller the ratio between the portion of the outer surface of the sealing element exposed to the swelling agent and the portion of the outer surface of the sealing element covered by the jacket, the smaller the value of the swell-rate (e.g., the sealing element will swell slower or at a slower rate). Additional advantages of the controlled swell-rate swellable packer such as the CSSP 200 and methods of using same may be apparent to one of skill in the art viewing this disclosure.

EXAMPLES

The embodiments having been generally described, the following examples are given as particular embodiments of the disclosure and to demonstrate the practice and advantages thereof. It is understood that the examples are given by way of illustration and are not intended to limit the specification or the claims in any manner.

Example 1

The swelling properties of swellable materials coated with various types of coatings (e.g., jackets) were investigated. More specifically, the swell curves for swellable materials were investigated both for coated and uncoated samples. The swellable material used was an oil-swellable rubber. The tested samples were either uncoated, or coated with ACCOLAN, ACCOAT or ACCOFLEX. The geometry of the tested samples was a hollow cylinder, wherein the outer diameter (OD) was 4.2 in, the inner diameter was 2.875 in, and the height was 0.1 m. The samples were coated with various patterns, such as a fine mesh, a coarse mesh, etc. The swelling agent used was EDC 95-11 drilling fluid.

Unless otherwise specified, the following procedure was used for the testing of hollow cylinder materials comprised of an oil-swellable rubber. The tests were conducted at 110° C. The hollow cylinder samples were placed at the bottom of an autoclavable test chamber, the chamber was filled with the swelling agent (e.g., EDC 95-11 drilling fluid), such that the sample(s) were fully covered, and then the autoclavable test chamber was heated at the desired temperature (e.g., 110° C.). The samples were positioned vertically in the autoclavable test chamber, such that the cylinder was "standing up." The autoclavable test chamber was equipped with one or more sensors to sense and/or record the expansion of the hollow cylinder sample.

Figure 5:
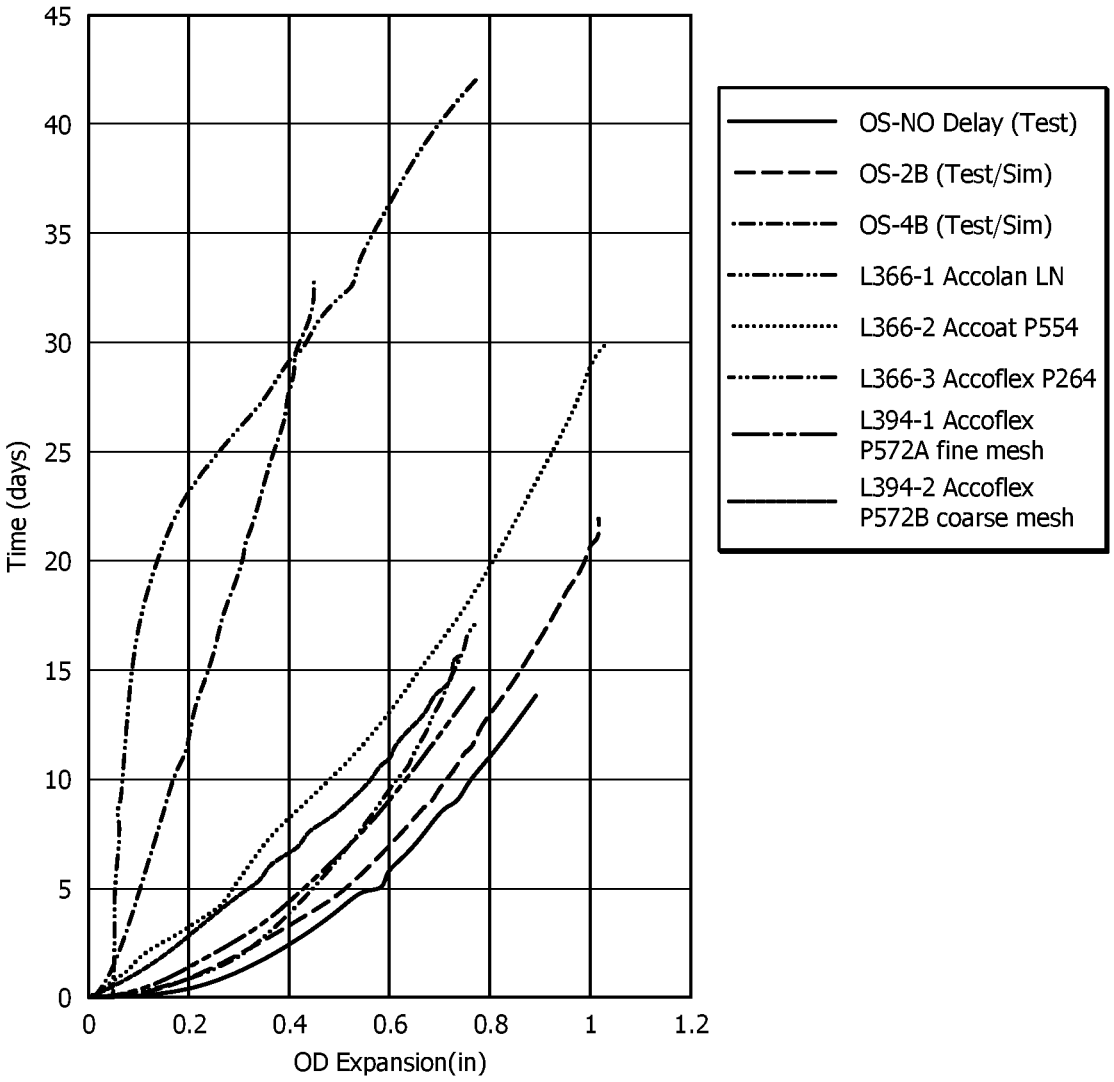
FIG. 5 displays the results of a swelling test for a swellable material in the presence and in the absence of various coatings or jackets.

The samples were submerged in EDC 95-11 drilling fluid for time periods of up to 45 days, and the outer diameter (OD) of the samples measured in inches (in) was recorded, and the data are displayed in FIG. 5. Generally, as it can be seen from FIG. 5, the uncoated samples exhibited expansion in the shortest amount of time, while coated samples generally took longer to expand.

Example 2

Figure 6A:
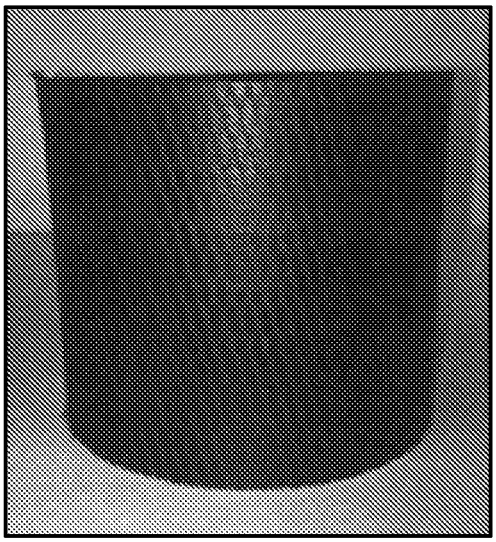
FIG. 6A is a picture of a swellable material coated with a fine mesh pattern.
Figure 6B:
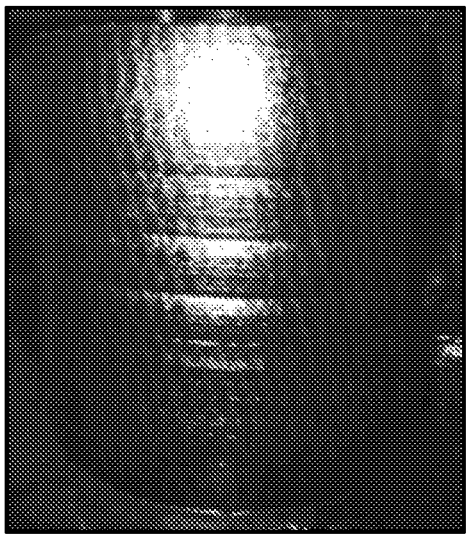
FIG. 6B is a picture of the swellable material coated with a fine mesh pattern of FIG. 6A upon swelling.
Figure 6C:
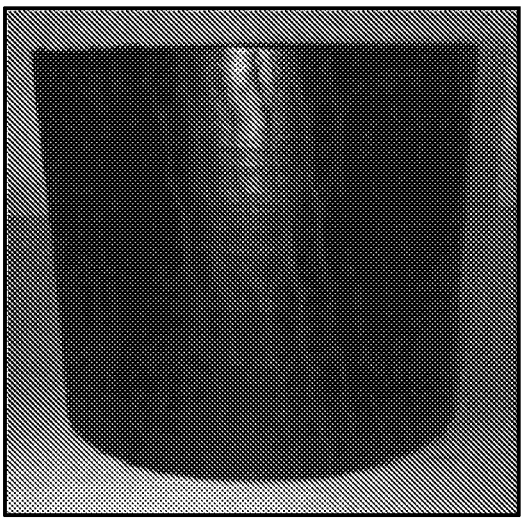
FIG. 6C is a picture of a swellable material coated with a coarse mesh pattern.
Figure 6D:
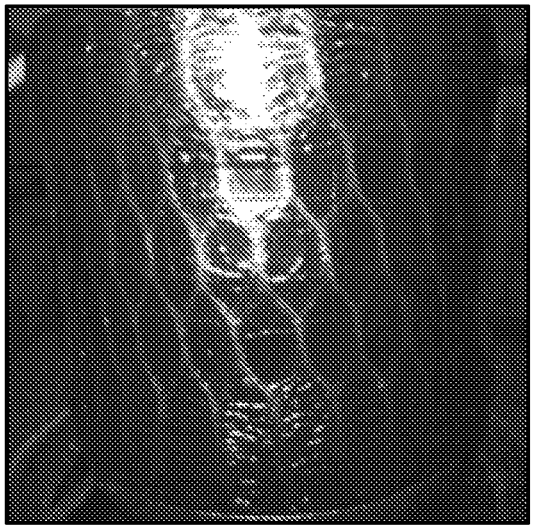
FIG. 6D is a picture of the swellable material coated with a fine coarse pattern of FIG. 6C upon swelling.

The swelling properties of controlled swell-rate swellable packers were investigated. More specifically, the controlled swell-rate swellable packers were visually monitored during swelling. The testing was conducted as described in Example 1. FIGS. 6A and 6B display the same sample (e.g., a swellable material coated with a fine mesh jacket) in two different stages: prior to swelling, and fully swollen, respectively. FIGS. 6C and 6D display the same sample (e.g., a swellable material coated with a coarse mesh jacket) in two different stages: prior to swelling, and fully swollen, respectively. The swellable material used was an oil-swellable rubber, the jacket was an ACCOFLEX coating, the swelling agent was EDC 95-11 drilling fluid, and the pattern was a mesh as it can be seen from FIGS. 6A, 6B, 6C, and 6D.

Example 3

Figure 7:
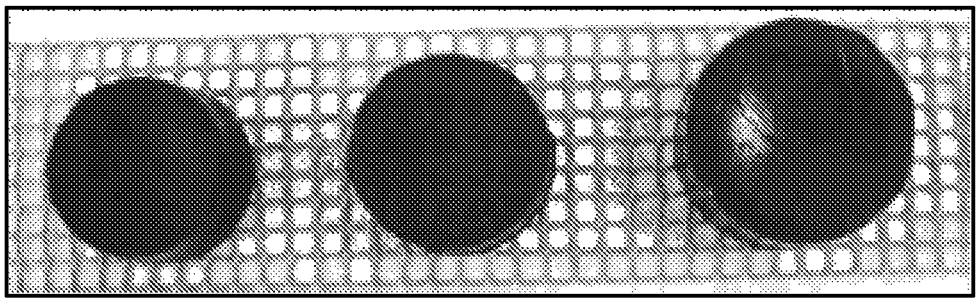
FIG. 7 is a picture of three samples of a swellable material coated in different ways, upon swelling.

The swelling properties of a swellable material were investigated. More specifically, the effect of the presence of a coating/jacket was visually monitored during swelling. Three similar samples (sample #1, sample #2 and sample #3) were studied as follows: sample #1 was fully coated; sample #2 was coated with a grid pattern, and sample #3 was uncoated. When used, the coating was ACCOFLEX. All three samples were made out of an oil-swellable rubber as the swellable material. The samples were submerged in EDC 95-11 drilling fluid as the swelling agent. The geometry of the samples before swelling was a cylinder. FIG. 7 displays three samples upon exposure to the swelling agent. As it can be seen, the uncoated swellable material (sample #3) exhibited the greatest expansion, while the fully coated swellable material (sample #1) exhibited the least expansion, and the partially coated swellable material (sample #2 coated with a grid-like pattern) exhibited an intermediate proportion of expansion.

Example 4

Figure 8:
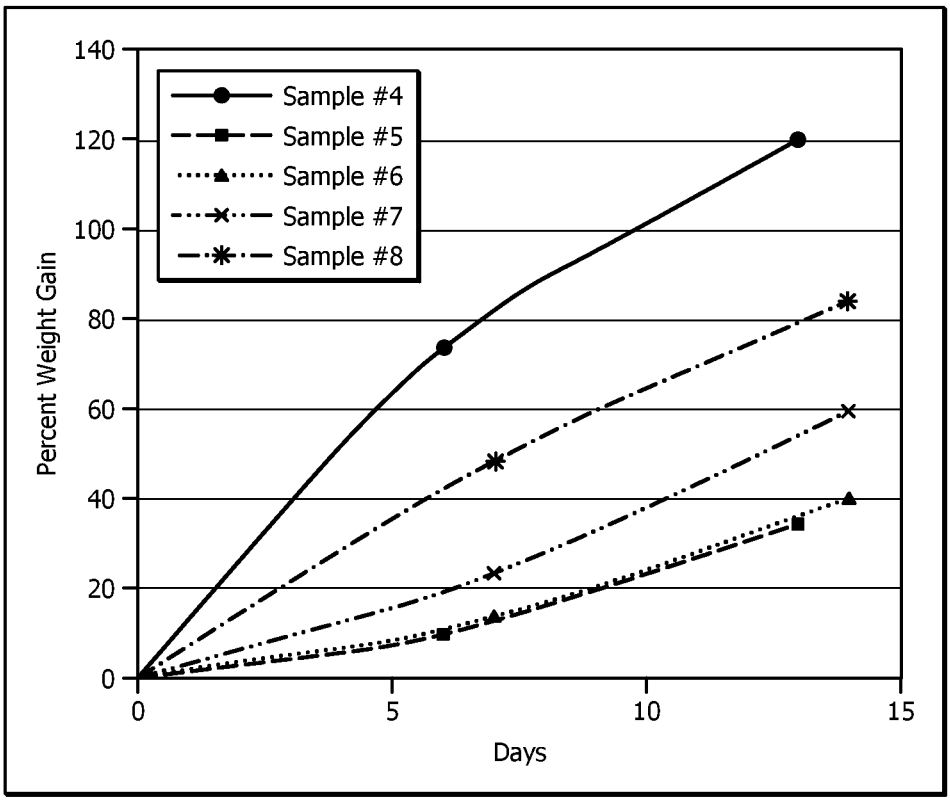
FIG. 8 displays the results of a swelling test for a swellable material coated with various patterns.

The swelling properties of swellable materials coated with various patterns of coatings or jackets were investigated. More specifically, the weight gain swell curves for swellable materials were investigated for various patterns. The swellable material used was an oil-swellable rubber. The geometry of the samples was a cylinder. The coating patterns were as follows: sample #4 was uncoated; sample #5 was fully coated; sample #6 was coated with few holes of uncoated areas; sample #7 was coated with many holes of uncoated areas; and sample #8 was coated with a mesh pattern of uncoated areas. The samples were submerged in EDC 95-11 drilling fluid as the swelling agent, and data points were recorded before exposure to the swelling agent, at 6 or 7 days of exposure, and then at 13 or 14 days of exposure to the swelling agent. The % weight gain was plotted against the time and the data are displayed in FIG. 8. Generally, when the coating applied to the swellable materials covered a larger surface area, the rates of expansion (e.g., in terms of percent weight gain) were slower.

Example 5

Figure 9:
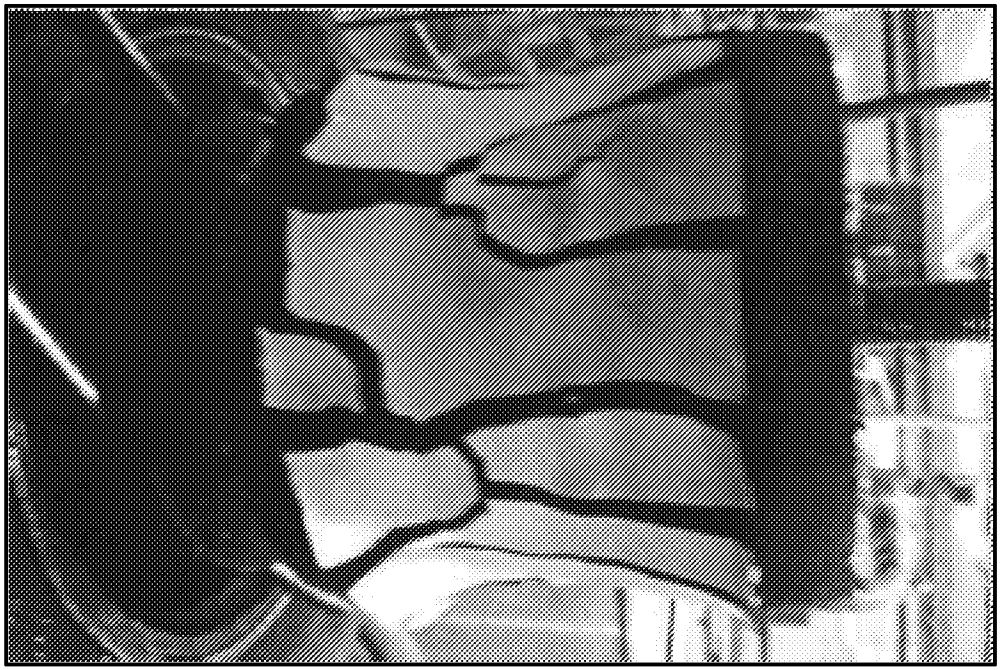
FIG. 9 is a picture of a sample of a swellable material coated with a partially flexible coating material, upon swelling.

The swelling properties of a swellable material coated with a partially flexible coating were investigated. More specifically, the effect of the presence of a partially flexible coating was visually monitored during swelling. A swellable material shaped as a hollow cylinder, with an OD of 4.2 in, an inner diameter of 2.875 in, and a height of 0.1 m, was exposed to a swelling agent. The swellable material used was an oil-swellable rubber, and the coating was ACCOAT, and the swelling agent was EDC 95-11 drilling fluid. The testing was conducted as described in Example 1. FIG. 9 displays an image of the fully swollen coated swellable material, wherein the partially flexible coat was observed to be cracked and peeling off the surface of the swellable material.

Additional Disclosure

The following are nonlimiting, specific embodiments in accordance with the present disclosure:

In a first embodiment, a controlled swell-rate swellable packer comprises a mandrel, a sealing element, wherein the sealing element is disposed about at least a portion of the mandrel, and a jacket, wherein the jacket covers at least a portion of an outer surface of the sealing element, and wherein the jacket is configured to substantially prevent fluid communication between a fluid disposed outside of the jacket and the portion of the outer surface of the sealing element covered by the jacket.

A second embodiment includes the controlled swell-rate swellable packer of the first embodiment, wherein the mandrel comprises a tubular body generally defining a continuous axial flowbore.

A third embodiment includes the controlled swell-rate swellable packer of the first or second embodiments, wherein the sealing element comprises a swellable material.

A fourth embodiment includes the controlled swell-rate swellable packer of the third embodiment, wherein the swellable material comprises a water-swellable material, an oil-swellable material, a water-and-oil-swellable material, or any combination thereof.

A fifth embodiment includes the controlled swell-rate swellable packer of the third embodiment, wherein the swellable material comprises a water-swellable material, and wherein the water-swellable material comprises a tetrafluorethylene/propylene copolymer (TFE/P), a starch-polyacrylate acid graft copolymer, a polyvinyl alcohol/cyclic acid anhydride graft copolymer, an isobutylene/maleic anhydride copolymer, a vinyl acetate/acrylate copolymer, a polyethylene oxide polymer, graft-poly(ethylene oxide) of poly(acrylic acid), a carboxymethyl cellulose type polymer, a starch-polyacrylonitrile graft copolymer, polymethacrylate, polyacrylamide, an acrylamide/acrylic acid copolymer, poly(2-hydroxyethyl methacrylate), poly(2-hydroxypropyl methacrylate), a non-soluble acrylic polymer, a highly swelling clay mineral, sodium bentonite, sodium bentonite having as main ingredient montmorillonite, calcium bentonite, derivatives thereof, or combinations thereof.

A sixth embodiment includes the controlled swell-rate swellable packer of the third embodiment, wherein the swellable material comprises an oil-swellable material, and wherein the oil-swellable material comprises an oil-swellable rubber, a natural rubber, a polyurethane rubber, an acrylate/butadiene rubber, a butyl rubber (IIR), a brominated butyl rubber (BUR), a chlorinated butyl rubber (CIIR), a chlorinated polyethylene rubber (CM/CPE), an isoprene rubber, a chloroprene rubber, a neoprene rubber, a butadiene rubber, a styrene/butadiene copolymer rubber (SBR), a sulphonated polyethylene (PES), chlor-sulphonated polyethylene (CSM), an ethylene/acrylate rubber (EAM, AEM), an epichlorohydrin/ethylene oxide copolymer rubber (CO, ECO), an ethylene/propylene copolymer rubber (EPM), ethylene/propylene/diene terpolymer (EPDM), a peroxide crosslinked ethylene/propylene copolymer rubber, a sulphur crosslinked ethylene/propylene copolymer rubber, an ethylene/propylene/diene terpolymer rubber (EPT), an ethylene/vinyl acetate copolymer, a fluoro silicone rubber (FVMQ), a silicone rubber (VMQ), a poly 2,2,1-bicyclo heptene (polynorbornene), an alkylstyrene polymer, a crosslinked substituted vinyl/acrylate copolymer, derivatives thereof, or combinations thereof.

A seventh embodiment includes the controlled swell-rate swellable packer of the third embodiment, wherein the swellable material comprises a water-and-oil-swellable material, and wherein the water-and-oil-swellable material comprises a nitrile rubber (NBR), an acrylonitrile/butadiene rubber, a hydrogenated nitrile rubber (HNBR), a highly saturated nitrile rubber (HNS), a hydrogenated acrylonitrile/butadiene rubber, an acrylic acid type polymer, poly(acrylic acid), polyacrylate rubber, a fluoro rubber (FKM), a perfluoro rubber (FFKM), derivatives thereof, or combinations thereof.

an eighth embodiment includes the controlled swell-rate swellable packer of any of the third to seventh embodiments, wherein the swellable material is characterized by a particle size of from about 0.1 microns to about 2000 microns.

A ninth embodiment includes the controlled swell-rate swellable packer of any of the first to eighth embodiments, wherein the jacket covers at least about 75% of the outer surface of the sealing element.

A tenth embodiment includes the controlled swell-rate swellable packer of any of the first to ninth embodiments, wherein the jacket comprises a primer coating layer.

An eleventh embodiment includes the controlled swell-rate swellable packer of the tenth embodiment, wherein the primer coating layer is characterized by a thickness of less than about 10 microns.

A twelfth embodiment includes the controlled swell-rate swellable packer of any of the first to eleventh embodiments, wherein the jacket comprises at least one top coating layer.

A thirteenth embodiment includes the controlled swell-rate swellable packer of the twelfth embodiment, wherein the top coating layer comprises plastics, polymeric materials, polyethylene, polypropylene, fluoro-elastomers, fluoropolymers, fluoropolymer elastomers, polytetrafluoroethylene, a tetrafluoroethylene/propylene copolymer (TFE/P), polyamide-imide (PAI), polyimide, polyphenylene sulfide (PPS), or combinations thereof.

A fourteenth embodiment includes the controlled swell-rate swellable packer of the twelfth or thirteenth embodiment, wherein the top coating layer comprises a flexible coating material or a partially flexible coating material.

A fifteenth embodiment includes the controlled swell-rate swellable packer of any of the twelfth to fourteenth embodiments, wherein the top coating layer is characterized by a thickness of from about 10 microns to about 100 microns.

A sixteenth embodiment includes the controlled swell-rate swellable packer of any of the first to fifteenth embodiments, further comprising a retention coating layer.

A seventeenth embodiment includes the controlled swell-rate swellable packer of the sixteenth embodiment, wherein the retention coating layer is characterized by a thickness of from about 1 micron to about 100 microns.

In an eighteenth embodiment, a method of making a controlled swell-rate swellable packer comprises applying a mask onto at least a portion of an outer surface of the sealing element; applying a jacket to the sealing element when the mask is applied; removing the mask after applying the jacket; and providing a controlled swell-rate swellable packer.

A nineteenth embodiment includes the method of the eighteenth embodiment, wherein the mask comprises void spaces.

A twentieth embodiment includes the method of the eighteenth or nineteenth embodiment, wherein applying the jacket to the sealing element comprises at least one of spraying a liquideous or substantially liquideous material onto the sealing element, painting a liquideous or substantially liquideous material onto the sealing element, or dipping the sealing element into a liquideous or substantially liquideous material.

A twenty first embodiment includes the method of any of the eighteenth to twentieth embodiments, further comprising drying the jacket before or after removing the mask.

A twenty second embodiment includes the method of any of the eighteenth to twenty first embodiments, further comprising applying a retention coating layer onto the outer surface of the sealing element.

A twenty third embodiment includes the method of the twenty second embodiment, wherein the retention coating layer is applied onto an outer surface of the controlled swell-rate swellable packer subsequent to removing the mask.

In a twenty fourth embodiment, a method of utilizing a controlled swell-rate swellable packer comprises disposing a tubular string comprising a controlled swell-rate swellable packer incorporated therein within a wellbore in a subterranean formation, wherein the controlled swell-rate swellable packer comprises a sealing element and a jacket, wherein the jacket covers at least a portion of an outer surface of the sealing element, and wherein the jacket is substantially impermeable to a fluid that is configured to cause the sealing element to swell upon contact between the sealing element and the fluid; and activating the controlled swell-rate swellable packer.

A twenty fifth embodiment includes the method of the twenty fourth embodiment, wherein the controlled swell-rate swellable packer further comprises a mandrel, wherein the sealing element is disposed circumferentially about at least a portion of the mandrel.

A twenty sixth embodiment includes the method of the twenty fourth or twenty fifth embodiment, wherein the sealing element comprises a swellable material.

A twenty seventh embodiment includes the method of the twenty sixth embodiment, further comprising allowing the controlled swell-rate swellable packer to swell by from about 105% to about 500% based on the volume of the swellable material of the sealing element prior to activating the controlled swell-rate swellable packer.

A twenty eighth embodiment includes the method of the twenty sixth embodiment, further comprising allowing the controlled swell-rate swellable packer to swell by from about 125% to about 200% based on the volume of the swellable material of the sealing element prior to activating the controlled swell-rate swellable packer.

A twenty ninth embodiment includes the method of any of the twenty fourth to twenty sixth embodiments, wherein a swell gap of the sealing element increases by from about 105% to about 250% based on the swell gap of the sealing element prior to activating the controlled swell-rate swellable packer.

A thirtieth embodiment includes the method of any of the twenty fourth to twenty sixth embodiments, wherein a swell gap of the sealing element increases by from about 110% to about 150% based on the swell gap of the sealing element prior to activating the controlled swell-rate swellable packer.

A thirty first embodiment includes the method of any of the twenty fourth to thirtieth embodiments, wherein the controlled swell-rate swellable packer further comprises a retention coating layer.

A thirty second embodiment includes the method of any of the twenty fourth to thirty first embodiments, further comprising isolating at least two adjacent portions of the wellbore using the controlled swell-rate swellable packer subsequent to activating the controlled swell-rate swellable packer.

A thirty third embodiment includes the method of any of the twenty fourth to thirty second embodiments, wherein activating the controlled-rate swellable packer comprises contacting at least a portion of the controlled swell-rate packer with a swelling agent.

A thirty fourth embodiment includes the method of the thirty third embodiment, wherein the swelling agent comprises a water-based fluid, an oil-based fluid, or any combination thereof.

A thirty fifth embodiment includes the method of any of the twenty fourth to thirty fourth embodiments, wherein the controlled swell-rate swellable packer has a linear swell-rate.

A thirty sixth embodiment includes the method of any of the twenty fourth to thirty fourth embodiments, wherein the controlled swell-rate swellable packer has a non-linear swell-rate.

A thirty seventh embodiment includes the method of any of the twenty fourth to thirty sixth embodiments, wherein a swell-rate of the controlled swell-rate swellable packer is controlled by varying a type and/or composition of a swelling material; a type and/or composition of a jacket; a number of layers in the jacket; a pattern of a mask; a ratio between a portion of an outer surface of a sealing element exposed to a swelling agent and a portion of the outer surface of the sealing element cover by the jacket; a type and/or composition of the swelling agent; or combinations thereof.

While embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_1$, and an upper limit, $R_u$, is disclosed, any number falling within the range is specifically disclosed. In particular, the following numbers within the range are specifically disclosed: $R=R_1+k*(R_u-R_1)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the embodiments of the present invention. The discussion of a reference in the Detailed Description of the Embodiments is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed is:

1. A method of making a controlled swell-rate swellable packer, comprising:

disposing a sealing element about at least a portion of a mandrel, wherein the sealing element is in sealing contact with the mandrel;

applying a mask onto at least a portion of an outer surface of the sealing element, wherein the sealing element comprises a swellable material, and wherein the mask comprises void spaces;

applying a jacket to the sealing element not covered by the mask when the mask is applied, wherein the mask substantially prevents the application of the jacket except in the void spaces;

removing the mask from the sealing element after applying the jacket to the sealing element not covered by the mask; and providing the controlled swell-rate swellable packer.

2. The method of claim 1, further comprising applying a retention coating layer onto the outer surface of the sealing element.

3. The method of claim 2, wherein the retention coating layer is applied onto an outer surface of the controlled swell-rate swellable packer subsequent to removing the mask.

* * * * *